US009233732B2

(12) United States Patent
Wilson

(10) Patent No.: US 9,233,732 B2
(45) Date of Patent: Jan. 12, 2016

(54) ADJUSTABLE PLANING DEVICE FOR PONTOON BOATS

(71) Applicant: Harley Wilson, Indianapolis, IN (US)

(72) Inventor: Harley Wilson, Indianapolis, IN (US)

( * ) Notice: Subject to any disclaimer, the term of this patent is extended or adjusted under 35 U.S.C. 154(b) by 0 days.

(21) Appl. No.: 14/599,688

(22) Filed: Jan. 19, 2015

(65) Prior Publication Data

US 2015/0136011 A1 May 21, 2015

Related U.S. Application Data

(63) Continuation-in-part of application No. 14/219,580, filed on Mar. 19, 2014, now Pat. No. 8,955,452.

(60) Provisional application No. 61/907,184, filed on Nov. 21, 2013.

(51) Int. Cl.

| | |
|---|---|
| ***B63B 1/12*** | (2006.01) |
| ***B63B 1/18*** | (2006.01) |
| ***B63B 1/20*** | (2006.01) |
| ***B63B 1/22*** | (2006.01) |
| ***B63B 35/34*** | (2006.01) |

(52) U.S. Cl.

CPC ... *B63B 1/22* (2013.01); *B63B 1/12* (2013.01); *B63B 1/121* (2013.01); *B63B 1/18* (2013.01); *B63B 1/20* (2013.01); *B63B 35/34* (2013.01)

(58) Field of Classification Search

CPC ..... B63B 1/10; B63B 2001/145; B63B 1/16; B63B 1/30

USPC ..... 114/61.1–61.25, 67 A, 127–139, 271, 114/274–287, 292; 180/116, 117

See application file for complete search history.

(56) References Cited

U.S. PATENT DOCUMENTS

| | | | | |
|---|---|---|---|---|
| 1,265,035 A | | 5/1918 | Bazaine | |
| 1,273,549 A | * | 7/1918 | Sloper | B64C 35/00 114/284 |
| 2,950,699 A | | 8/1960 | Ogden et al. | |

(Continued)

FOREIGN PATENT DOCUMENTS

| | | | | |
|---|---|---|---|---|
| GB | 492046 A | * | 9/1938 | B63B 1/22 |
| JP | 09193883 A | * | 7/1997 | |

OTHER PUBLICATIONS

Pontoon Water Glide. [retrieved Nov. 21, 2013]. Retrieved from the Internet: <URL: http://www.pontoonwaterglide.com/history.asp>.

*Primary Examiner* — Ajay Vasudeva

(74) *Attorney, Agent, or Firm* — Woodard, Emhardt, Moriarty, McNett & Henry LLP

(57) ABSTRACT

Adjustable planing device mounted midship on a pontoon boat to provide lift to the pontoon boat, reduce drag, and improve steering. Adjustable planing device includes a planing device having a connector member with a hinge that is rotatably attached to a midship region of the boat wherein the planing device is pivotable about the hinge by a powered actuator such that a portion of the planing device comprises a subsurface volume below water level. Optionally the planing device is buoyant. The planing device is adjustable vertically relative to the boat to vary the depth of water displaced by the planing device. The adjustable planing device is movable along a track mountable to the bottom of either the boat or cross-members wherein the longitudinal position of the planing device is adjusted. The cross-sectional shape of the planing device varies from a tapered shape in front to a flatter shape in rear.

23 Claims, 18 Drawing Sheets

(56) References Cited

U.S. PATENT DOCUMENTS

| | | | | | |
|---|---|---|---|---|---|
| 3,146,752 | A | | 9/1964 | Ford | |
| 3,236,202 | A | * | 2/1966 | Quady | B63B 1/12 114/279 |
| 3,289,226 | A | | 12/1966 | Thompson | |
| 3,401,663 | A | * | 9/1968 | Yost | B63B 1/14 114/283 |
| 3,998,176 | A | | 12/1976 | Stout et al. | |
| 4,067,286 | A | | 1/1978 | Stout et al. | |
| 4,348,977 | A | | 9/1982 | Okajima | |
| 4,351,262 | A | | 9/1982 | Matthews | |
| RE31,563 | E | | 4/1984 | Stout et al. | |
| 4,494,477 | A | | 1/1985 | Matthews | |
| 4,655,157 | A | * | 4/1987 | Sapp | B63B 1/18 114/283 |
| 4,669,408 | A | | 6/1987 | Schad | |
| 4,821,663 | A | | 4/1989 | Schad | |
| 4,883,012 | A | | 11/1989 | Kennedy | |
| 4,896,621 | A | | 1/1990 | Coles | |
| 4,951,591 | A | | 8/1990 | Coles | |
| 5,117,774 | A | * | 6/1992 | English | B63C 11/49 114/61.1 |
| 5,259,331 | A | | 11/1993 | Hagan | |
| 5,465,678 | A | | 11/1995 | Ekman | |
| 5,787,828 | A | * | 8/1998 | Barbier | B63B 1/107 114/274 |
| 6,016,762 | A | | 1/2000 | Price | |
| 6,482,056 | B1 | | 11/2002 | Schell-Tomczak et al. | |
| 7,182,033 | B1 | | 2/2007 | Phillips et al. | |
| 7,204,196 | B2 | | 4/2007 | Coles | |
| 7,913,636 | B2 | | 3/2011 | Meyer | |
| 8,955,452 | B1 | * | 2/2015 | Wilson | 114/284 |
| 2006/0162639 | A1 | | 7/2006 | Costello | |
| 2011/0132251 | A1 | | 6/2011 | Wilson | |

* cited by examiner

ADJUSTABLE PLANING DEVICE FOR PONTOON BOATS

CROSS-REFERENCE TO RELATED APPLICATION

This application is a continuation-in-part of U.S. patent application Ser. No. 14/219,580, filed Mar. 19, 2014, now U.S. Pat. No. 8,955,452, which claims the benefit of U.S. Provisional Patent Application No. 61/907,184, filed Nov. 21, 2013, which are hereby incorporated by reference.

BACKGROUND

The present invention relates to an adjustable planing device that is attached to a midship region of a pontoon boat to provide more lift and reduce drag of the pontoon boat. Existing mechanisms that attach to a pontoon boat or other watercraft for adjusting the lift and drag of the pontoon boat or other watercraft are available. One mechanism includes a pair of foils that are attached to an undersurface of a pontoon boat at the rear end of the boat wherein each is positioned between a respective pontoon and a motor mount. Another mechanism includes attaching a planing foil to a catamaran boat wherein the foil is positioned between the waterline and the lower surfaces of the hulls or floats when the boat is at rest so that the planing foil rises toward a planing position on the surface of the water as the catamaran boat is propelled therealong in order to lift the boat and reduce drag. Thus, there is a need for improvement in this field.

SUMMARY

The invention is defined in the claims, and only the claims. This summary is not limiting.

For owners and enthusiasts of pontoon boats, round bottoms on the typical outboard pontoon offer poor surface area for lift. The adjustable planing device disclosed herein is for outboard, inboard, and sterndrive (outdrive) powered pontoon boats. There are many benefits of the adjustable planing device disclosed herein. One benefit is the adjustable planing device increases the speed of the pontoon boat with the existing motor of the pontoon boat. A corresponding benefit is the boat owner saves money since the boat owner does not have to purchase a higher horsepower motor to increase the speed of the boat. Instead, the boat owner typically uses the existing motor on their pontoon boat and simply mounts the adjustable planing device to their pontoon boat. By using the adjustable planing device, the pontoon boat will require less or the same horsepower to push the boat through the water at a faster speed. The planing device offers pontoon boat owners a means of increasing boat speed when they are running a maximum legal horsepower engine on their pontoon boat. Another benefit of the adjustable planing device for pontoon boat owners is to offer a modular device that is easy to install and provides more surface area for contact with the water which in turn provides more lift (reducing drag) that results in more speed and better fuel economy. Another result and benefit is that the adjustable planing device will require less horsepower for more top end speed of the pontoon boat.

A unique design of the adjustable planing device, which will be described in greater detail below, has been developed to address these as well as other issues. The adjustable planing device provides a planing plate or surface that can be raised and lowered to account for different gross weights of the pontoon boat, passengers, and cargo to obtain the optimum speed and boat attitude. In one embodiment, one or more double acting hydraulic cylinders or powered actuators are used to raise and lower the planing plate that is hinged at the front end to a modular frame. The modular frame is attached to the underside of the pontoon boat in about the midship region of the boat. The modular frame is configured to attach to various locations of the midship region of the boat. The lift cylinder(s) or powered actuators provide enough power to raise the weight of the boat, people, equipment and the water pressure against it, and the design of the hydraulic system locks the cylinders in the selected position. The planing plate can be lowered and locked from its starting position or raised and lowered while under power or while the pontoon boat is moving.

Another unique design of the adjustable planing device, which will be described in greater detail below, has been developed to address these as well as other issues. The adjustable planing device can be moved forward or rearward along the longitudinal axis of the boat, lowered from its starting position, or raised and lowered while under power or while the pontoon boat is moving. As such the adjustable planing device allows longitudinal, vertical, and rotational adjustments of a planing device to achieve the following benefits. The adjustable planing device provides a planing device or surface that sits level in the water and can be lowered further into the water to account for different gross weights of the pontoon boat, passengers, and cargo to obtain the optimum speed and boat attitude. In one form, the planing device is buoyant wherein a portion of the planing device comprises a subsurface volume below water level when the planing device is attached to a pontoon boat in water. The subsurface volume has an average density less than one kilogram per liter density of water. The adjustable planing device includes a level position wherein the planing device that is buoyant rests on the water surface to provide additional lift similar to a pontoon. The planing device has a tapered front end portion that increases speed and improves the steerability, the fuel economy, and the comfort of the ride of the pontoon boat. The planing device widens to a rear end portion that is flatter than the front end portion which provides additional lift for the pontoon boat. The planing device that is buoyant can be sealed and air tight to provide additional buoyancy that will increase lift and load capacity of the pontoon boat. In some embodiments the planing device is foam filled and made of fiberglass. In one embodiment, the adjustable planing device is mounted or attached to the midship region beneath the boat. In an alternate embodiment, the adjustable planing device includes a modular frame that is attached to the midship region of the boat. In yet another embodiment, the adjustable planing device includes a track that is mountable on the boat to enable movement of the adjustable planing device forward and aft with respect to the boat. One example of a track includes a first mounting rail and a second mounting rail attached to the boat. The first and the second mounting rails are attached to the cross-members of a pontoon boat and span along the longitudinal axis of the pontoon boat. In this embodiment, the modular frame is movable along the first and the second mounting rails manually or by a linear actuator, driver, or some other mechanical device that moves the modular frame along a longitudinal axis of the boat to enable the boat owner to adjust the longitudinal position of the adjustable planing device for a particular boat size and load. The modular frame is typically positioned in about the midship region of the boat.

In one embodiment, the planing device is attached to the modular frame in a first manner that also allows a vertical adjustment of the planing device relative to the modular frame to raise or lower the planing device. The planing device is also attached to the modular frame in a second manner that allows a rotational adjustment wherein the rear end portion of the buoyant planning device rotates or pivots about the modular frame to further engage and press against the water at a lower elevation than the front end portion. In one embodiment, one or more double acting hydraulic cylinders or powered actuators are used to raise and lower the planing device that is hinged at the front end to the modular frame. The lift cylinder(s) provide enough power to raise the weight of the boat, people, equipment and the water pressure against it wherein the design of the hydraulic system also locks the cylinders in the selected position. Positioning the hydraulic cylinders or powered actuators closer to the rear end portion of the planing device will beneficially allow better adjustment of the attitude of the pontoons, lift the pontoons which results in less drag, and increase speed and fuel economy. Moreover, during operation or use of the pontoon boat, an operator can adjust the attitude of the pontoon boat for different loads and weather conditions by operating the hydraulic cylinders or powered actuators. For example, a simple toggle switch on the boat console operates the hydraulic pump to activate the hydraulic cylinders which are double acting allowing up and down movement.

Optionally, the planing device includes a first sponson attached to the right side of the planing device and a second sponson attached to the left side of the planing device wherein the sponsons are arranged to contact the waterline when the planing device is in the lowered position to further lift the pontoon boat. Optionally, the planing device can include a propulsion unit or mechanism to propel the pontoon boat thereby eliminating the need for a motor on the pontoon boat.

Since the adjustable planing device is modular in design, the adjustable planing device can be removed from a first pontoon boat and installed on a replacement or second pontoon boat should the user elect to do so. Installation of the adjustable planing device does not require significant modification of the structure of the boat. Instead, in a first embodiment, simply drilling holes in the pontoon cross-members for attachment with mechanical fasteners to the modular frame are the only mounting requirements. In a second embodiment, a track such as a first mounting rail and a second mounting rail are attached to the cross-members of a pontoon boat wherein the first and second mounting rails are configured to receive and retain the modular frame. The first and second mounting rails span along a longitudinal axis of the pontoon boat and enable a pontoon boat owner to move the modular frame along the rails to adjust the longitudinal location of the modular frame as desired. In one embodiment, the adjustable planing device includes a hydraulic power system for moving the planing plate or planing device. Components of the power system can be mounted inside any storage area (normally under a seat) of the pontoon boat. Another benefit of installing the adjustable planing device on a pontoon boat is by changing the attitude of the pontoon boat, there is an increase in speed and better fuel economy of the pontoon boat. In one embodiment, a trim indicator gauge is added on the dash of the pontoon boat that lets the operator know the position or angle of the planing plate or device. The trim indicator provides a visual aid for the boat operator on the position of the planing plate or device for optimum performance for different loads on the pontoon boat and water conditions.

Another unique embodiment of an adjustable planing device for a pontoon boat having a midship region that spans between a front end and a rear end is described next and in more detail below. The adjustable planing device comprises a connector member having a transverse hinge configured to attach to the midship region of the pontoon boat, a buoyant planing device having a front end portion opposite a rear end portion, the buoyant planing device attached to the connector member at the midship region beneath the boat and being pivotable about the hinge such that at least a portion of the buoyant planing device comprises a subsurface volume below water level wherein the subsurface volume has an average density less than a one kilogram per liter density of water, and a powered actuator connected to the boat and to the buoyant planing device, the actuator operable to move the buoyant planing device downwardly into the water. Optionally, the adjustable planing device also includes a first sponson attached to a right side of the buoyant planing device and a second sponson attached to a left side of the buoyant planing device, wherein the first and the second sponsons are configured to contact the waterline to lift the pontoon boat.

Also optionally, the adjustable planing device also includes a modular frame having a front member opposite a rear member, a right member opposite a left member, wherein the right and left members, respectively, span between the front member and the rear member, and wherein the modular frame is attachable to the midship region of the pontoon boat and the connector member is attached to the front member. In this embodiment, the connector member has a first set of interacting features and the connector member is attached to the front member of the modular frame and a vertical member having a second set of interacting features, the vertical member mounted to the front end portion of the buoyant planing device, wherein the first and second sets of interacting features are configured to connect with each other to attach the vertical member to the connector member at a desired vertical position such that the buoyant planing device is selectively positioned vertically relative to the pontoon boat. Optionally, a mounting member can be attached to a top surface of the buoyant planing device, wherein the powered actuator is attached to the mounting member and the modular frame. Alternatively, the powered actuator is attached to the rear member of the modular frame. In another embodiment, a cross-member extends between the right and the left members of the modular frame wherein the powered actuator is attached to the cross-member of the modular frame.

Yet another unique embodiment of an adjustable planing device for a pontoon boat having a midship region that spans between a front end and a rear end is described next and in more detail below. The adjustable planing device comprises a connector member having a transverse hinge configured to attach to the midship region of the pontoon boat, a planing device having a front end portion opposite a rear end portion, the planing device attached to the connector member at the midship region beneath the boat and being pivotable about the hinge such that at least a portion of the planing device comprises a subsurface portion below water level, a powered actuator connected to the boat and to the planing device, the actuator operable to move the planing device downwardly into the water, and a track mountable to the bottom of the boat, wherein the planing device, the connector member and the powered actuator are selectively movable together along the track forward and aft with respect to the boat. Optionally, the adjustable planing device also includes a modular frame having a front member opposite a rear member, a right member opposite a left member, wherein the right and left members, respectively, span between the front member and the rear member and the track includes a first mounting rail and a second mounting rail wherein the first and the second mounting rails are mountable to the bottom of the boat. The first mounting rail is configured to receive the right member of the modular frame and the second mounting rail is configured to receive the left member of the modular frame such that the modular frame, the planing device, the connector member and the powered actuator are selectively movable together along the first and the second mounting rails. Optionally, the adjustable planing device also includes a first sponson attached to a right side of the planing device and a second sponson attached to a left side of the planing device, wherein the first and the second sponsons are configured to contact the waterline. In one embodiment, the front end portion of the planing device has a vee cross-sectional shape and the rear end portion of the buoyant planing device has a semi-circular cross-sectional shape. In another embodiment, the connector member also has a first set of holes and a vertical member is mounted to the planing device, the vertical member having a second set of holes, wherein the first and the second sets of holes are arranged to align with each other. A plurality of fasteners are mounted through the first and the second sets of holes to attach the connector member to the vertical member to selectively adjust a vertical position of the planing device. Optionally, a drive assembly is attached to the midship region of the pontoon boat wherein the drive assembly is configured to move the planing device, the connector member and the powered actuator along the track. Typically, the rear end portion of the planing device is movable to a lower vertical position from a minimum of about 3 inches to a maximum of about 17 inches.

Yet another unique embodiment of an adjustable planing device for a pontoon boat having a midship region that spans between a front end and a rear end is described next and in more detail below. The adjustable planing device comprises a connector member having a transverse hinge configured to attach to the midship region of the pontoon boat, a planing device having a front end portion opposite a rear end portion, the planing device attached to the connector member at the midship region beneath the boat and being pivotable about the hinge midship such that at least a portion of the planing device comprises a subsurface portion below water level, a powered actuator connected to the boat and to the planing device, the actuator operable to move the planing device downwardly into the water, and a vertical member mountable to the planing device and to the connector member, wherein the planing device and the vertical member are selectively movable together vertically up and down with respect to the boat to vary how deep into the water the powered actuator moves the planing device downwardly into the water. Optionally, the connector member has a first set of connecting features and the vertical member has a second set of connecting features, wherein the first and second sets of connecting features are configured to connect with each other such that the planing device and the vertical member are selectively movable together vertically up and down with respect to the boat. In one embodiment, a track is mountable to the bottom of the boat, wherein the planing device, the connector member and the powered actuator are selectively movable together along the track forward and aft with respect to the boat. In another embodiment, a modular frame has a front member opposite a rear member, a right member opposite a left member, wherein the right and left members, respectively, span between the front member and the rear member, the connector member being attached to the front member. In this embodiment the track includes a first mounting rail and a second mounting rail mountable to the pontoon boat wherein the first mounting rail is configured to receive the right member of the modular frame and the second mounting rail is configured to receive the left member of the modular frame, wherein the position of the modular frame, the connector member, the planing device, and the powered actuator are selectively movable together along the first and the second mounting rails. Also optionally, a first sponson is attached to a right side of the planing device and a second sponson is attached to a left side of the planing device, wherein the first and the second sponsons are configured to contact the waterline.

Another embodiment of the adjustable planing device includes a first longitudinal planing plate and a second longitudinal planing plate positioned in a side by side orientation and rotatably attached to a modular frame. In this embodiment, the first and the second longitudinal planing plates operate independently of each other. Beneficially, this independent operation provides lateral trimming and improved steering of the pontoon boat.

In yet another embodiment, a skirt plate is attached to the rear end of the planing plate to provide additional surface contact area of the planing plate. Beneficially, the skirt plate provides additional lift to the pontoon boat.

In other embodiments, the adjustable planing device is installed on a tritoon boat or boats with three or more pontoons. Beneficially, the adjustable planing device provides independent trimming and improved steering as well as increased performance.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
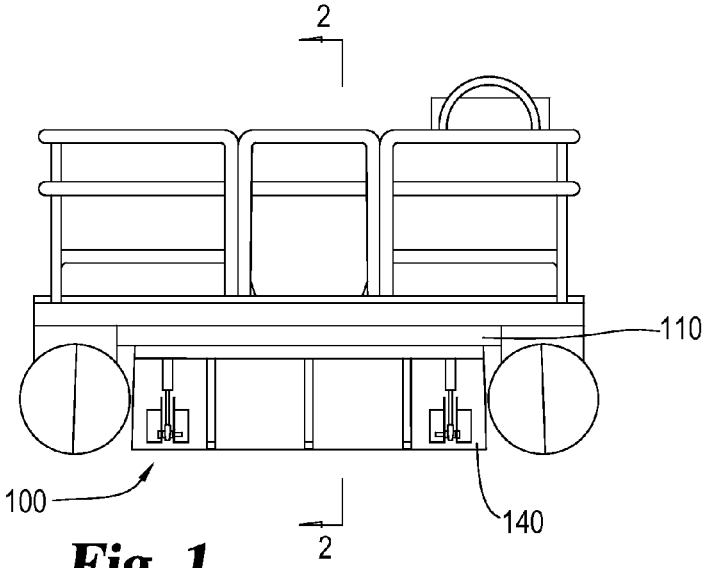
FIG. 1 is a rear view of an adjustable planing device mounted to a pontoon boat.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
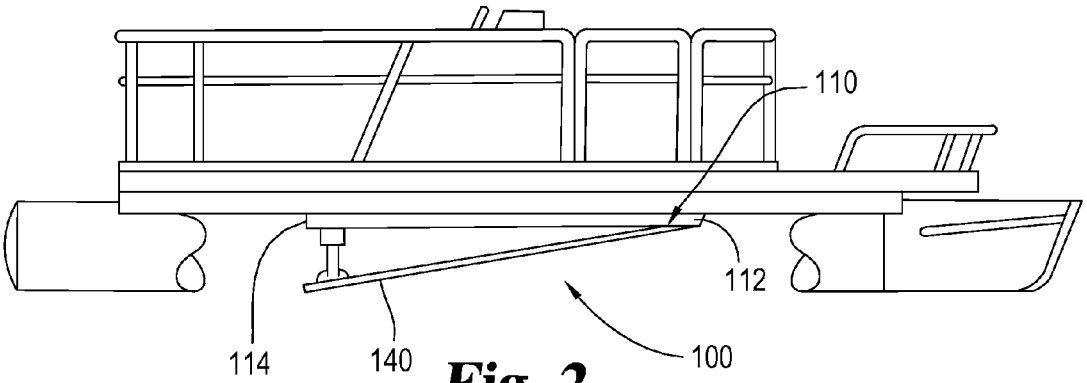
FIG. 2 is a cross-sectional view of the FIG. 1 embodiment.

A first embodiment of an adjustable planing device 100 is illustrated in FIGS. 1-9. In FIGS. 1 and 2, the adjustable planing device 100 is attached to a pontoon boat. More specifically, the pontoon boat has a midship region that spans between a front end and a rear end. The adjustable planing device 100 includes a modular frame 110 and a planing plate 140.

As illustrated in FIGS. 1-4, the modular frame 110 is configured to attach to the midship region of the pontoon boat. As such, the modular frame 110 has a front member 112 opposite a rear member 114 and a right member 116 opposite a left member 118 wherein the right and the left members 116 and 118 span between the front member 112 and the rear member 114. In this embodiment, the modular frame 110 includes a cross-member 120 that spans between the right and the left members 116 and 118, respectively. In other embodiments, the modular frame 110 includes additional cross-members 120 that span between the right and the left members 116 and 118. In some embodiments, the length of each of the right and the left members 116 and 118 and the length of each of the front and the rear members 112 and 114 is sized to accommodate a particular sized pontoon boat. In the illustrated embodiment, the right and left members 116 and 118 and the front and the rear members 112 and 114 have a channel or C cross-sectional shape. However, other embodiments can include different cross-sectional shapes such as, but not limited to, L-shaped angles, I-beams, tubes, and/or rectangular shapes.

Figure 8:
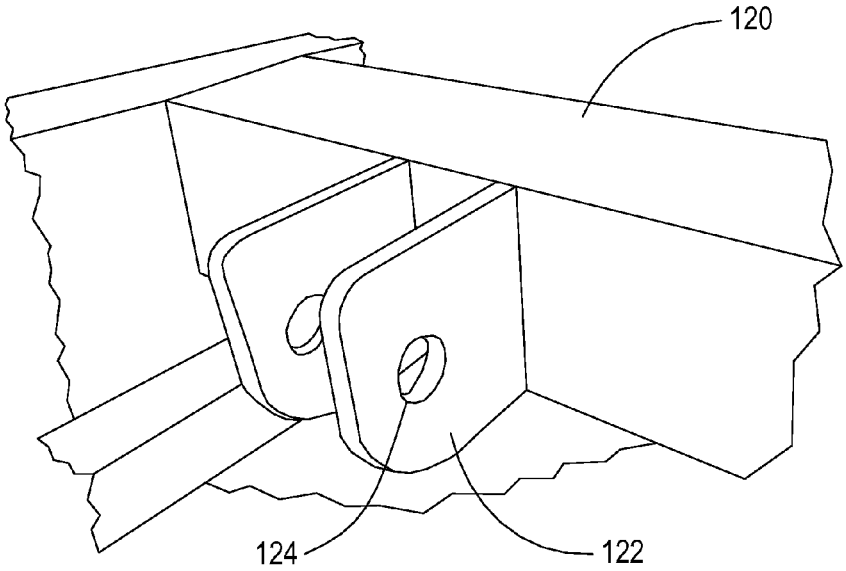
FIG. 8 is a side perspective view of a pair of mounting plates of the modular frame of the adjustable planing device from FIG. 1.

As illustrated in FIG. 8, the cross-member 120 includes a pair of mounting plates 122 configured for attachment of a hydraulic cylinder or other mechanism that is configured to move the planing plate 140. As described below, the hydraulic cylinder or other mechanism is also attached to the planing plate 140. In this embodiment, each of the mounting plates 122 includes a hole 124 sized to receive a bolt or other mechanical device to attach the hydraulic cylinder thereto. In one embodiment, one or more of the front member 112, the rear member 114, the right member 116, the left member 118, and/or the cross-member 120 includes a plurality of holes 125 sized to receive a bolt or other mechanical fastener to connect the corresponding member of the modular frame 110 to the pontoon floor and/or the existing structural cross-members of the pontoon boat. The plurality of holes 125 enables the optimum position of the modular frame 110 to be located relative to the pontoon boat and, in one particular embodiment, the modular frame 110 is attached to the midship region of the pontoon boat. Moreover, the plurality of holes 125 enables a single adjustable planing device 100 to be used with any one of differently sized pontoon boats.

In the illustrated embodiment, the modular frame 110 includes a first longitudinal stiffener 126 that spans between the front member 112 and the cross-member 120 wherein the first longitudinal stiffener 126 is positioned across from one of the pairs of mounting plates 122. In this form, the modular frame 110 also includes a second longitudinal stiffener 128 that spans between the front member 112 and the cross-member 120 wherein the second longitudinal stiffener 128 is positioned across from the other of the pairs of mounting plates 122. In other embodiments the modular frame 110 includes additional longitudinal stiffeners that span between the front member 112 and the cross-member 120. Alternatively, the modular frame 110 may not include any longitudinal stiffeners in other embodiments.

Figure 3:
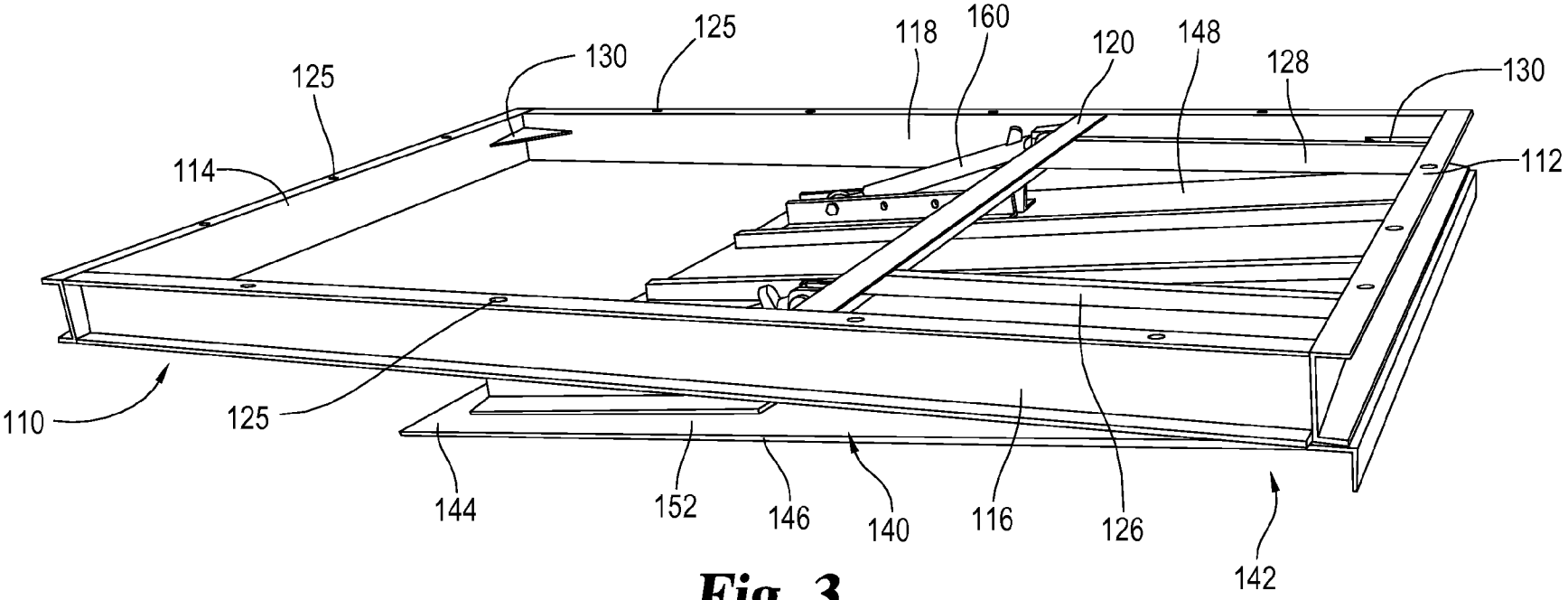
FIG. 3 is a top perspective view of the adjustable planing device from FIG. 1 in a raised position.
Figure 4:
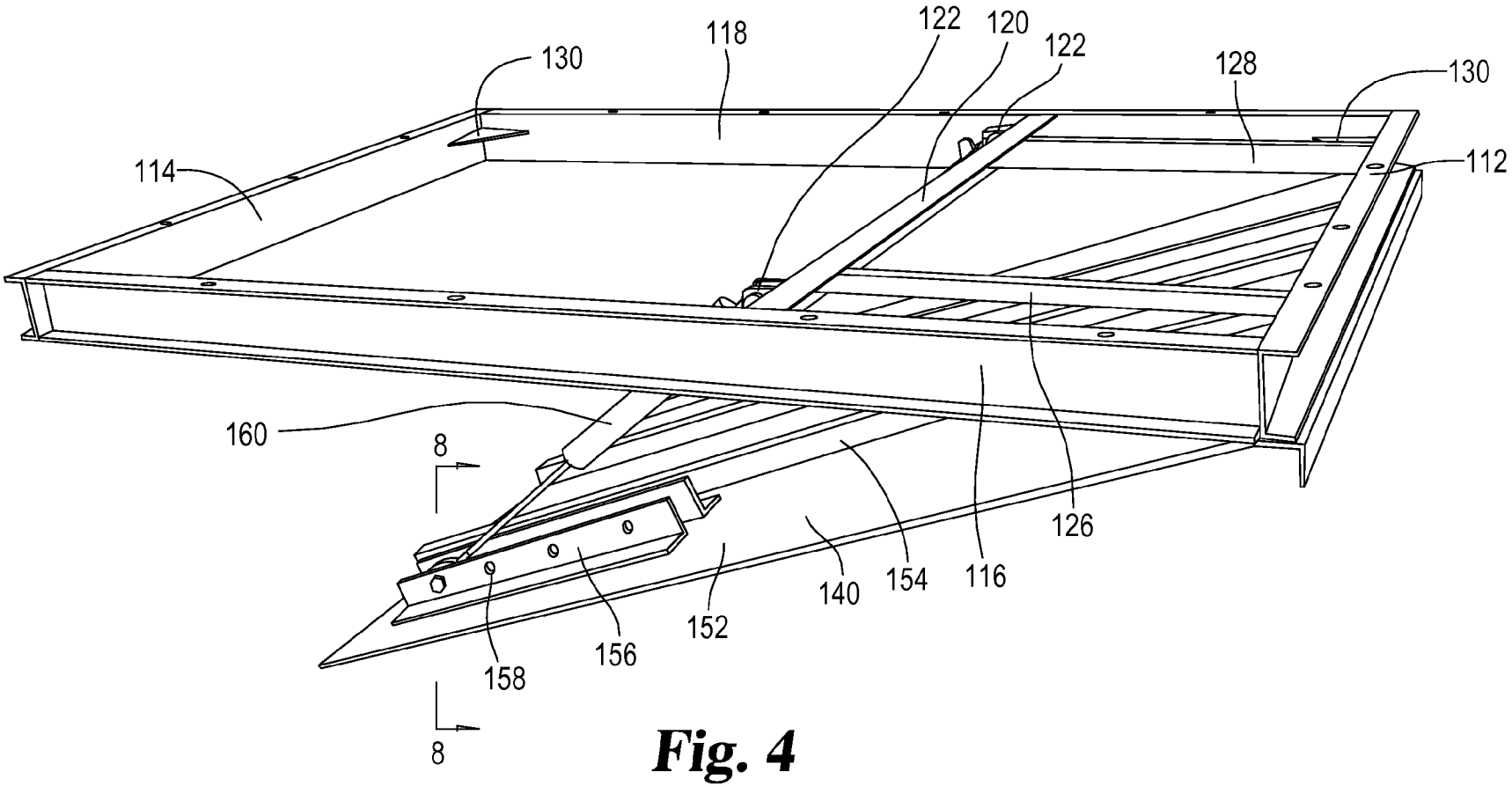
FIG. 4 is a top perspective view of the adjustable planing device from FIG. 1 in a lowered position.

As illustrated in the embodiment in FIGS. 3 and 4, the modular frame 110 includes a stiffener plate 130 that is mounted at each of the joints between the right and the left members 116 and 118 and the front and the rear members 112 and 114. As such, the stiffener plate 130 is mounted at the joint between the right member 116 and the front member 112 and another of the stiffener plate 130 is mounted at the joint between the right member 116 and the rear member 114. Correspondingly, although not illustrated in FIGS. 3 and 4, the modular frame 110 includes a third stiffener plate 130 mounted at the joint between the left member 118 and the front member 112 and a fourth stiffener plate 130 mounted at the joint between the left member 118 and the rear member 114. The stiffener plate 130 has a flat triangular shape; however, other embodiments can include an L-shape, a tube shape, a channel, or other shapes that are configured to reinforce the joint between two members. Other embodiments of the modular frame 110 may not include any stiffener plates.

Figure 6:
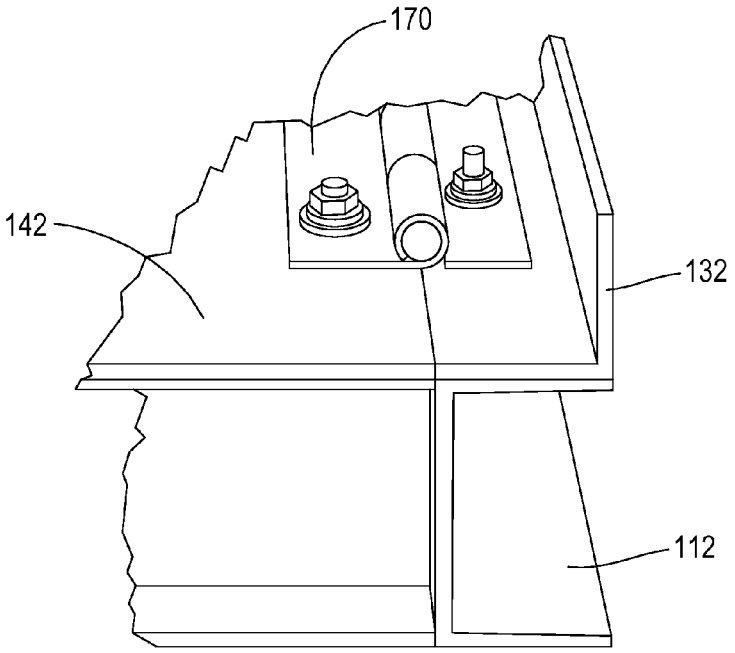
FIG. 6 is a partial side perspective view of a rear end of the adjustable planing device from FIG. 5.

In one embodiment illustrated in FIG. 6, the modular frame 110 includes a stiffener member 132 that is attached to and spans the length of the front member 112. The stiffener member 132 has an angle or L-shape for a cross-sectional shape in the illustrated embodiment but can be configured differently in other embodiments such as a flat plate or a channel shape to name a few. Other embodiments of the modular frame 110 may not include the stiffener member 132.

The modular frame 110 can be made from various materials combinations of materials, such as, metal, aluminum, steel, plastic, and fiberglass, to name a few.

Figure 5:
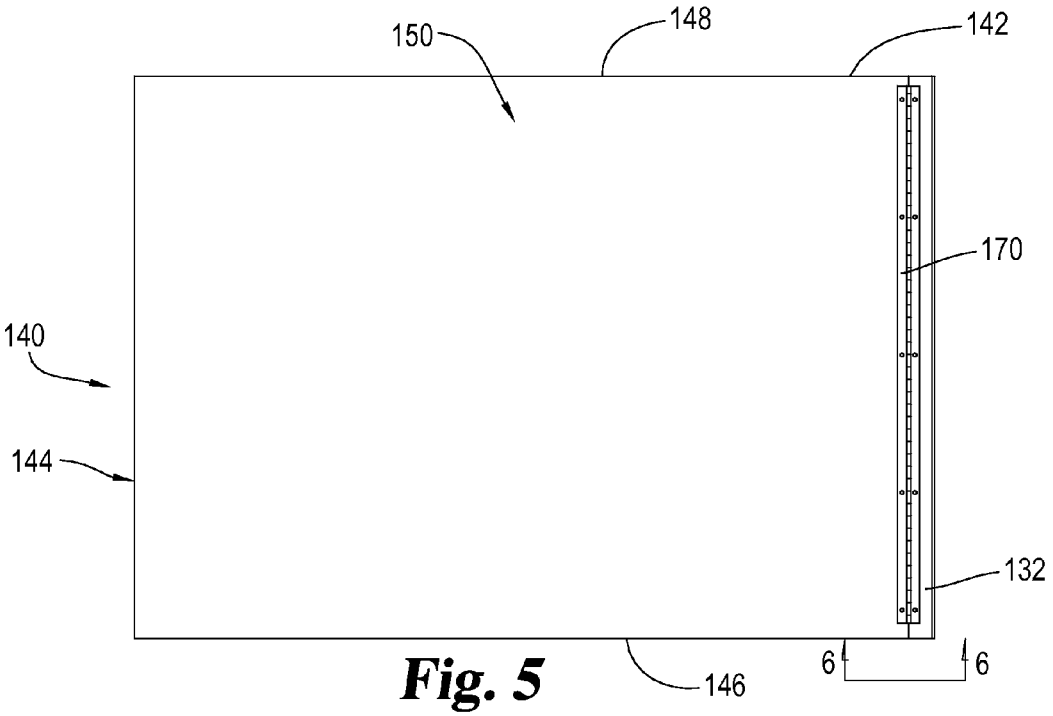
FIG. 5 is a bottom view of a planing plate of the adjustable planing device from FIG. 1.
Figure 7:
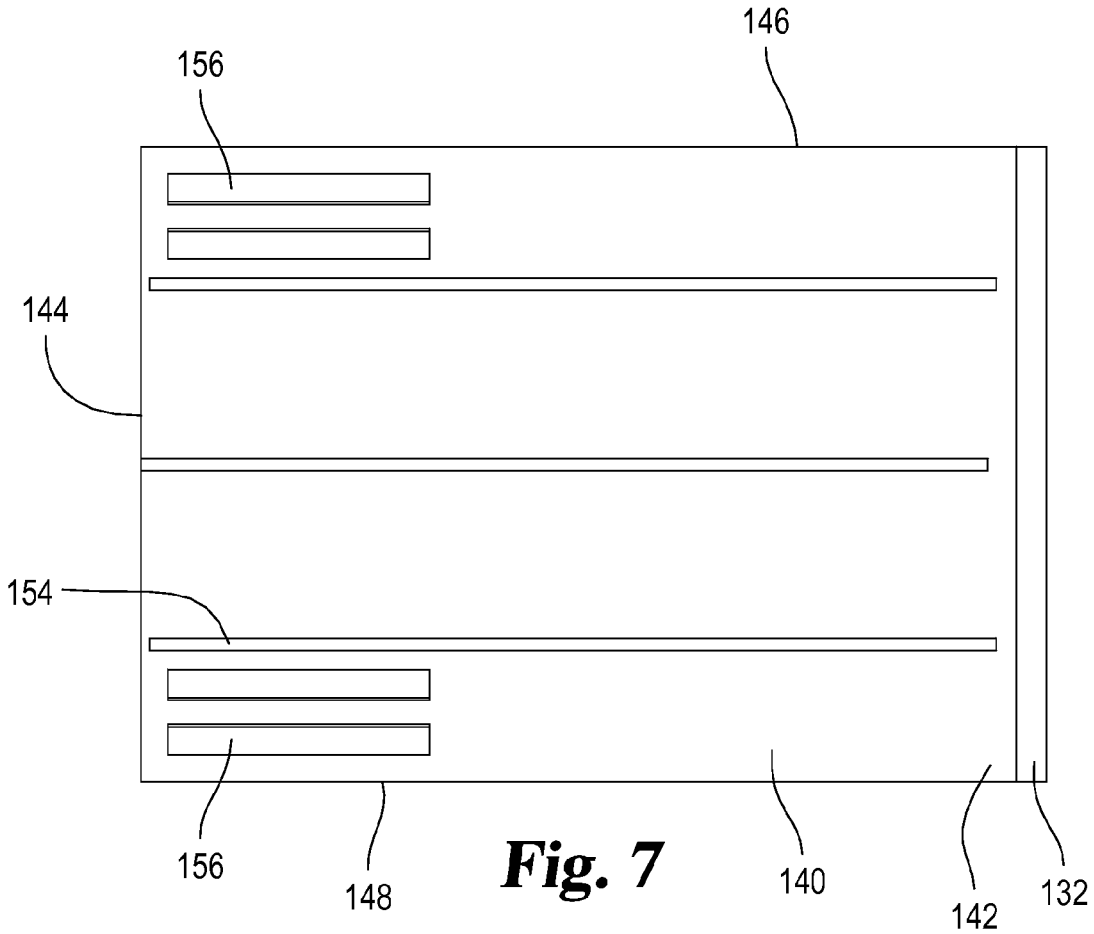
FIG. 7 is a top view of the planing plate of the adjustable planing device from FIG. 1.

As illustrated in FIGS. 5 and 7, the planing plate 140 includes a front end 142 opposite a rear end 144 and a right edge 146 opposite a left edge 148 wherein the right and the left edges 146 and 148, respectively, span between the front and the rear ends 142 and 144. The planing plate 140 also includes a lower planing face 150 opposite an upper planing face 152 wherein the lower and the upper faces 150 and 152 span between the front end 142 and the rear end 144 of the planing plate 140. As illustrated in FIG. 5, the lower planing face 150 has a substantially smooth surface to engage the waterline when the pontoon boat is in water. In the illustrated embodiment shown in FIG. 7, the planing plate 140 includes a plurality of spaced support members 154 positioned on the upper planing face 152 wherein the support members 154 are configured to reinforce the planing plate 140. In this form, three support members 154 are attached to the upper planing face 152; however, other configurations may include more or less support members 154. The support members 154 span from the front end 142 to the rear end 144 but in other embodiments may have a shorter length. The support members 154 have a generally rectangular cross-sectional shape, but in other embodiments the support members 154 have a channel shape, an I shape, an L shape, a flat plate, or any other shape that will reinforce the planing plate 140.

Figure 9:
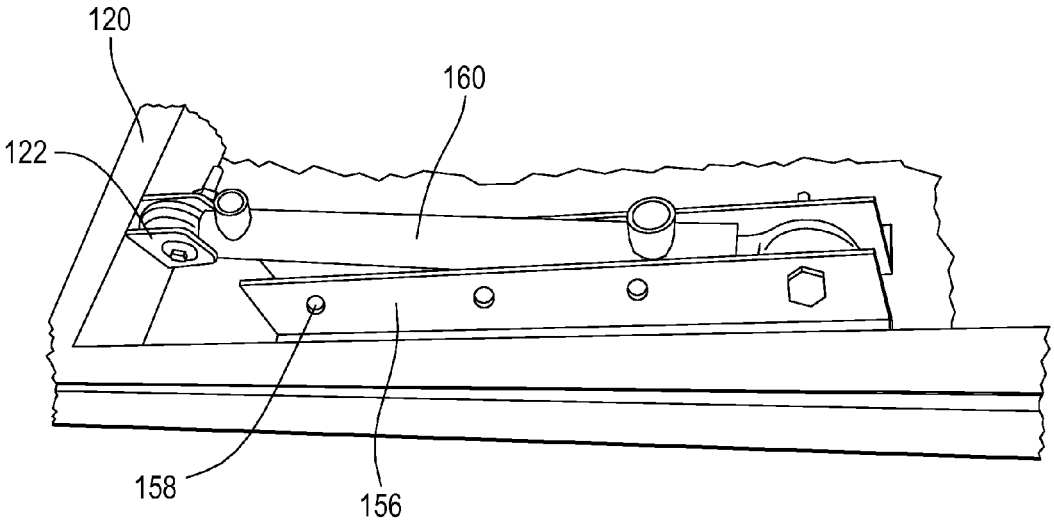
FIG. 9 is one embodiment of a pair of mounting members with multiple holes of adjustably mounting a hydraulic cylinder of the adjustable planing device from FIG. 1.

In the embodiment illustrated in FIGS. 7 and 9, the planing plate 140 includes two pairs of mounting members 156 spaced apart from one another. The pairs of mounting members 156 include one or more holes 158 for mounting one end of a hydraulic cylinder 160 between a pair of the mounting members 156. Other embodiments can include an alternative configuration for attaching the hydraulic cylinder 160 or other mechanical device to the mounting members 156. In the illustrated embodiment, the mounting members 156 are L-shaped but can include other shapes such as channels or I beams. As can be appreciated, the hydraulic cylinders 160 can be mounted either vertical from the modular frame 110 or using a linkage arrangement which can be fabricated to allow the hydraulic cylinder 160 to be mounted in other positions.

The planing plate 140 can be a welded assembly or formed by a hydraulic press. The planing plate 140 can be made of various materials, such as, metal, aluminum, steel, plastic, and fiberglass, to name a few. In one form, the planing plate 140 is a fiberglass molded unit (foam filled) that would provide a planing surface as well as increased buoyancy.

In the illustrated embodiment shown in FIGS. 5 and 6, the planing device 100 includes a hinge connection 170 that is attached to the front end 142 of the planing plate 140 and the stiffener member 132 of the modular frame 110 to enable the rear end 144 of the planing plate 140 to rotate away from the modular frame 110 allowing the rear end 144 to move up and down. The hinge connection 170 spans between the right and the left edges 146 and 148 along the front end 142. Bolts attach the hinge connection 170 to the front end 142 of the planing plate 140 and the stiffener member 132. The hinge connection 170 can be made of stainless steel. Other embodiments include different rotatable connections between the front end 142 of the planing plate 140 and the stiffener member 132 of the modular frame 110 or between the front end 142 and the front member 112 if no stiffener member 132 is present. In any embodiment, the front end 142 of the planing plate 140 is rotatably attached to the front member 112 of the modular frame 110 such that the planing plate 140 is rotatable between a raised position wherein the rear end 144 of the planing plate 140 is above the waterline and a lowered position wherein the rear end 144 of the planing plate 140 is configured to engage the waterline to lift the pontoon boat when the adjustable planing device 100 is mounted to the underside of a pontoon boat positioned in water. In one embodiment, the rear end 144 of the planing plate 140 does not go any lower than the bottom of the pontoons when in a lowered position. In another embodiment, the rear end 144 of the planing plate 140 does go lower than the bottom of the pontoons when in a lowered position.

Figure 10:
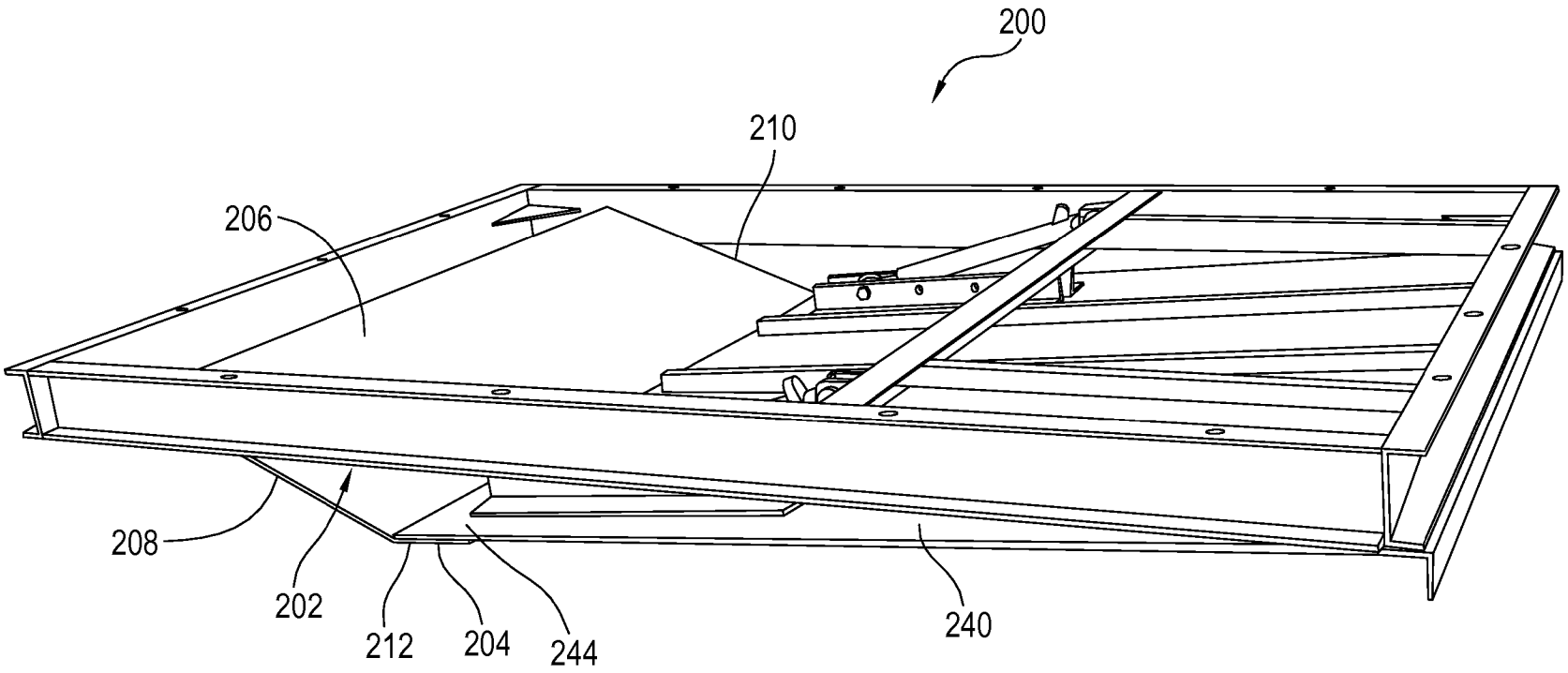
FIG. 10 is a top perspective view of a second embodiment of the adjustable planing device in a raised position.
Figure 11:
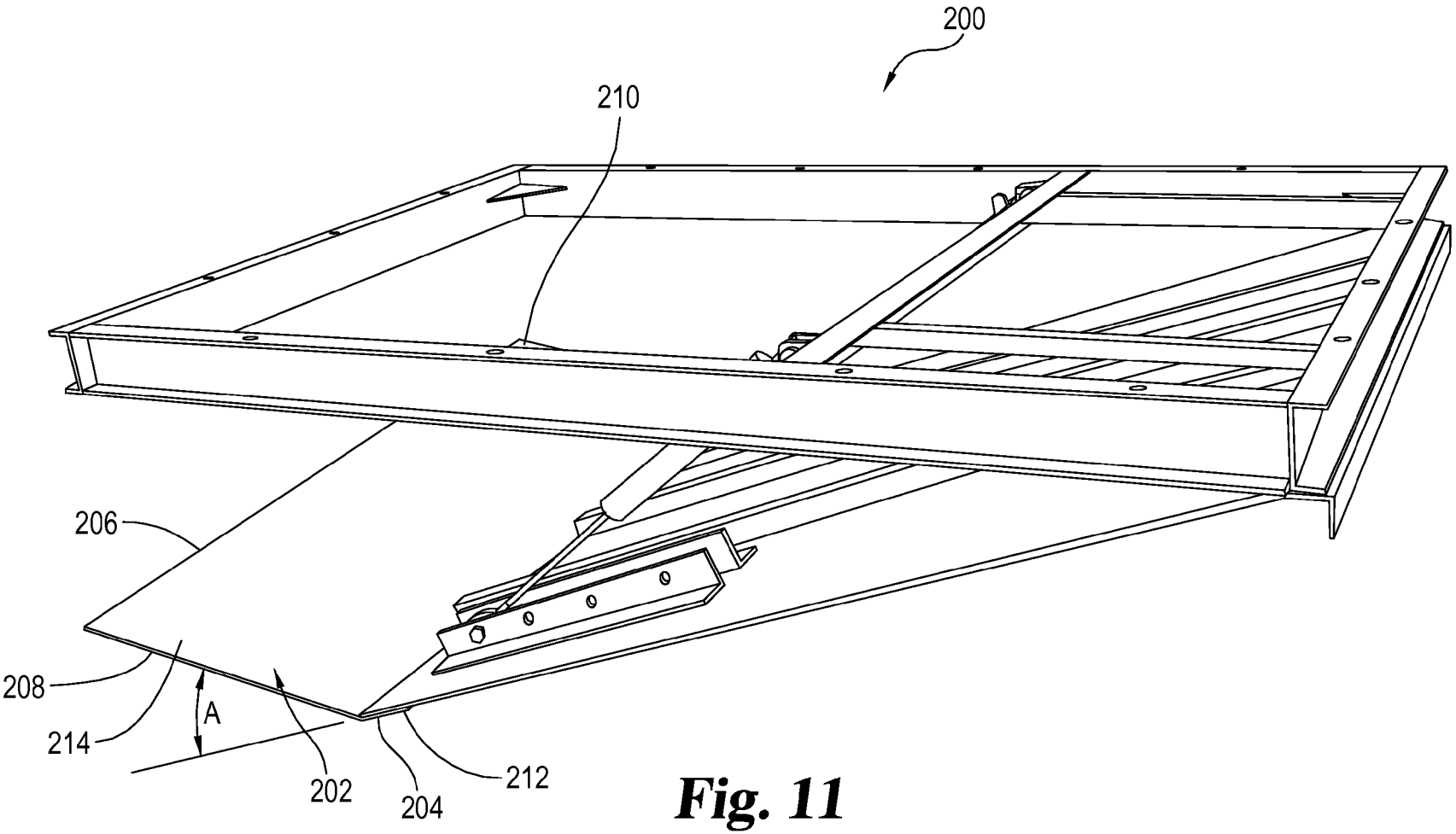
FIG. 11 is a top perspective view of the adjustable planing device from FIG. 10 in a lowered position.

A second embodiment of a planing device 200 is illustrated in FIGS. 10 and 11. The planing device 200 is similar to planing device 100 in all aspects; therefore similar details will not be described. The planing device 200 includes a skirt plate 202 attached to a planing plate 240. The skirt plate 202 has a front end 204 opposite a rear end 206 and a right edge 208 opposite a left edge 210 wherein the right and the left edges 208 and 210 span the length of the front and the rear ends 204 and 206. The front end 204 includes a toe portion 212 that spans between the right and the left edges 208 and 210, respectively. In this embodiment, the toe portion 212 is attached to a rear end 244 of the planing plate 240. The toe portion 212 can be attached to the planing plate 240 by various techniques such as welds, glue, bolts, or other mechanical fasteners. The toe portion 212 has a length that is necessary to safely attach the skirt plate 202 to the planing plate 240 to enable operation of the planing device 200 without the skirt plate 202 becoming detached from the planing plate 240. The skirt plate 202 also includes a deflector portion 214 that spans from the toe portion 212 to the rear end 206. In the illustrated embodiment, the deflector portion 214 forms an angle, A, with the toe portion 212. Angle A can vary from zero degrees to about 60 degrees and in one preferred embodiment angle A is about 30 degrees. The skirt plate 202 is attached to the planing plate 240 to provide additional surface area and thus more lift for the pontoon boat. More specifically, the skirt plate 202 is attached to the planing plate 240 to create more planing surface for a longer pontoon boat. Alternatively, for a longer pontoon boat, the planing plate 140 can be made longer.

Figure 12:
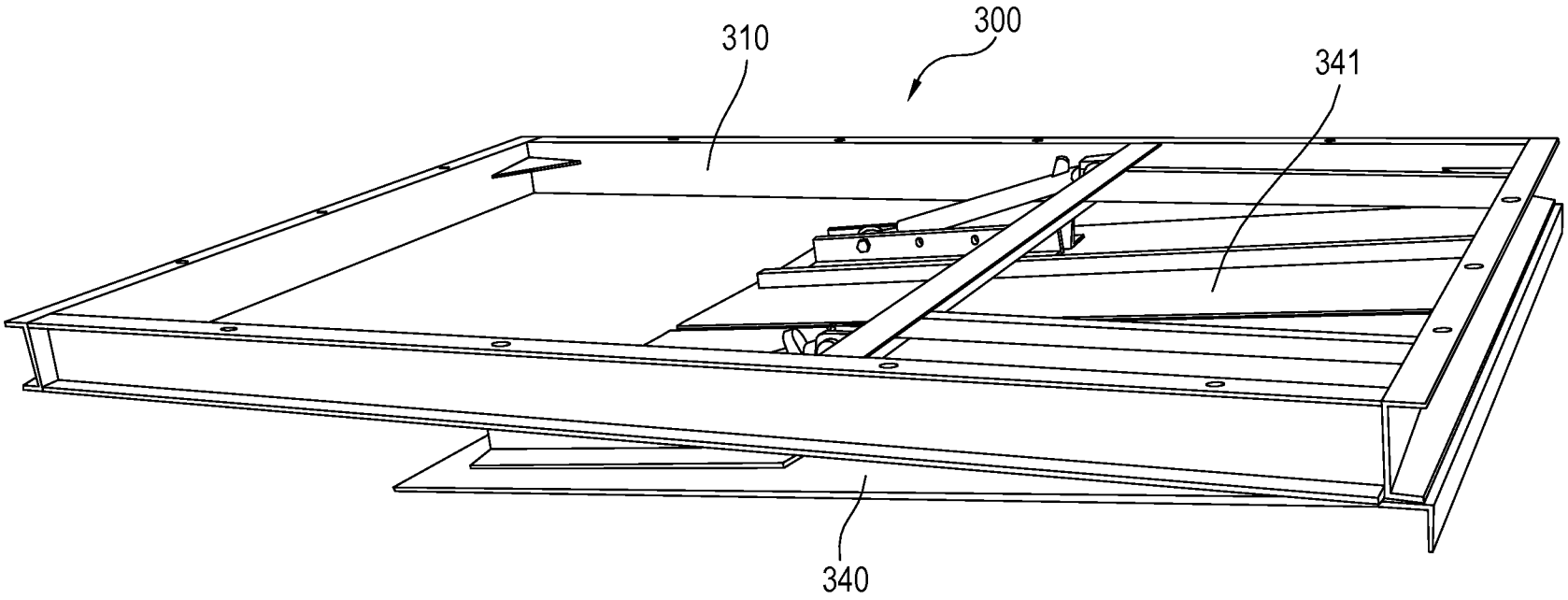
FIG. 12 is a top perspective view of a third embodiment of the adjustable planing device in a raised position.
Figure 13:
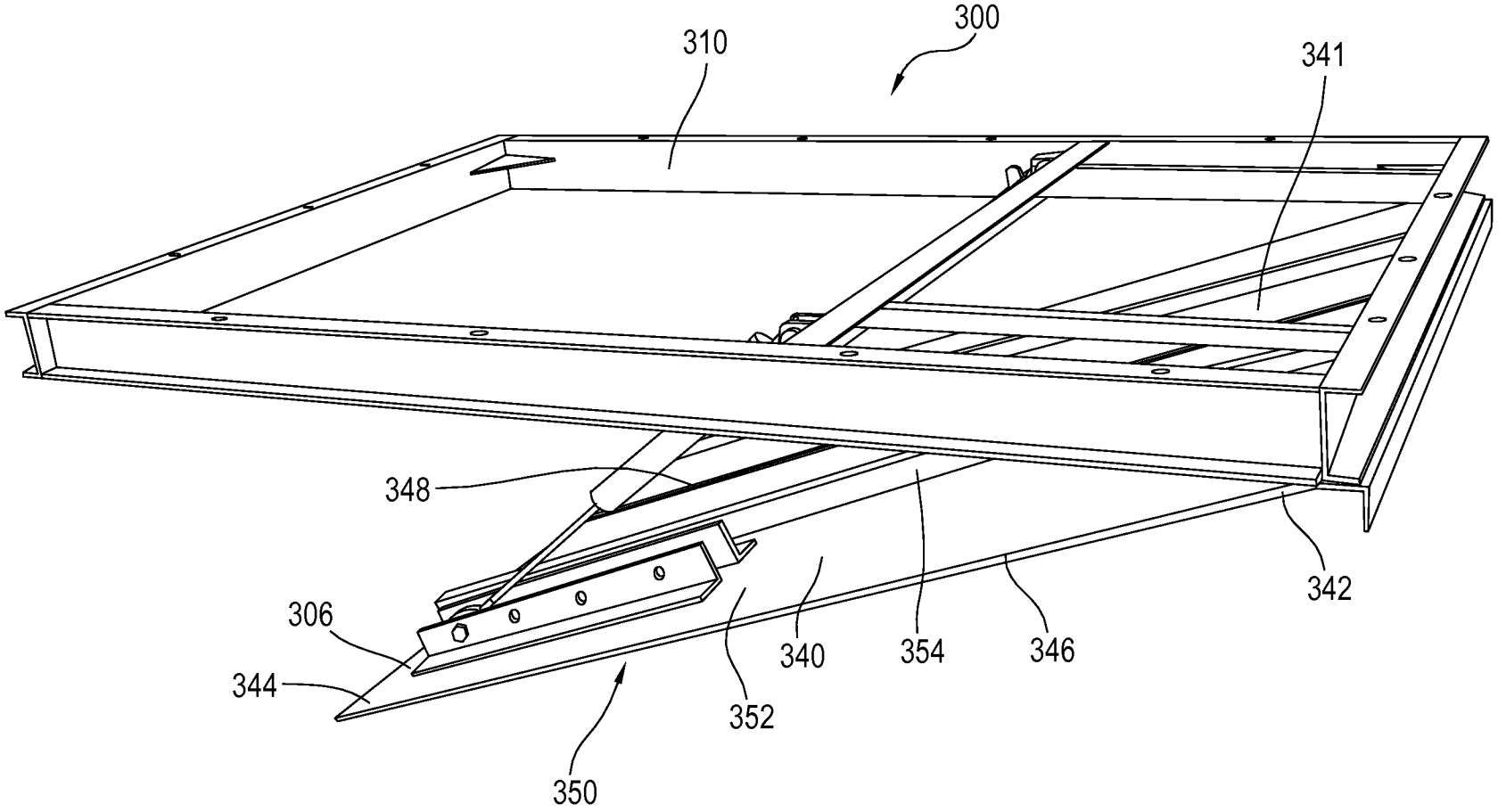
FIG. 13 is a top perspective view of the adjustable planing device from FIG. 12 in a lowered position.

A third embodiment of a planing device 300 is illustrated in FIGS. 12 and 13. The planing device 300 is similar to planing device 100 in all aspects; therefore similar details will not be described. The planing device 300 includes a first longitudinal planing plate 340 and a second longitudinal planing plate 341 arranged in a side by side orientation. The first longitudinal planing plate 340 and the second longitudinal planing plate 341 are each configured to move independently of one another. The first longitudinal planing plate 340 is similar to the second longitudinal planing plate 341; therefore, for the sake of brevity only the first longitudinal planing plate 340 is described. The length of the first longitudinal planing plate 340 is about the same as the length of the second longitudinal planing plate 341, and the width of the first longitudinal planing plate 340 is about the same as the width of the second longitudinal planing plate 341.

The first longitudinal planing plate 340 includes a front end 342 opposite a rear end 344 and a right edge 346 opposite a left edge 348 wherein the right and the left edges 346 and 348 span between the front and the rear ends 342 and 344. The first longitudinal planing plate 340 also includes a lower planing face 350 opposite an upper planing face 352 wherein the lower and the upper faces 350 and 352 span between the front end 342 and the rear end 344 of the first longitudinal planing plate 340. The lower planing face 350 has a substantially smooth surface to engage the waterline when the pontoon boat is in water. In the illustrated embodiment shown in FIGS. 12 and 13, the first longitudinal planing plate 340 includes a support member 354 positioned on the upper planing face 352 wherein the support member 354 is configured to reinforce the first longitudinal planing plate 340. In this form, one support member 354 is attached to the upper planing face 352; however, other configurations may include more or less support members 354. The support member 354 spans from the front end 342 to the rear end 344 but in other embodiments may have a shorter length. The support member 354 has a generally rectangular cross-sectional shape but in other embodiments the support member 354 has a channel or C shape, an I shape, an L shape, a flat plate, or any other shape that will reinforce the first longitudinal planing plate 340.

The first and the second longitudinal planing plates 340 and 341 are rotatably connected to a modular frame 310 similarly as planing plate 140 is rotatably attached to modular frame 110. For example, a hinge connection is placed between each of the first and the second longitudinal planing plates 340 and 341 such that the first and the second longitudinal planing plates 340 and 341 move independently of one another. The first and the second longitudinal planing plates 340 and 341 move individually between a raised position wherein one or both of the first or the second longitudinal planing plates 340 and 341 is elevated above the waterline and a lowered position wherein one or both of a rear end 306 and the rear end of the second longitudinal planing plate 341 engages the waterline to lift the pontoon boat.

Also similarly to planing device 100, a single hydraulic cylinder is attached to each of the first and the second longitudinal planing plates 340 and 341 and the modular frame 310. Two hydraulic cylinders enable the first and the second longitudinal planing plates 340 and 341 to operate independently of one another to provide lateral trimming and improved steering of the boat. The first and the second longitudinal planing plates 340 and 341 are controlled by two toggle switches or a joy stick controller (not illustrated).

Optionally, the planing device 300 includes a first skirt plate (not illustrated) attached to a rear end 306 of the first longitudinal planing plate 340, wherein the first skirt plate is configured to engage the waterline to lift the pontoon boat when the first longitudinal planing plate 340 is rotated to the lowered position. Optionally, the planing device 300 includes a second skirt plate (not illustrated) attached to the rear end of the second longitudinal planing plate 341, wherein the second skirt plate is configured to engage the waterline to lift the pontoon boat when the second longitudinal planing plate 341 is rotated to the lowered position. The first and the second skirt plates can each include a deflector portion that forms an angle, A, with a toe portion.

Figure 14:
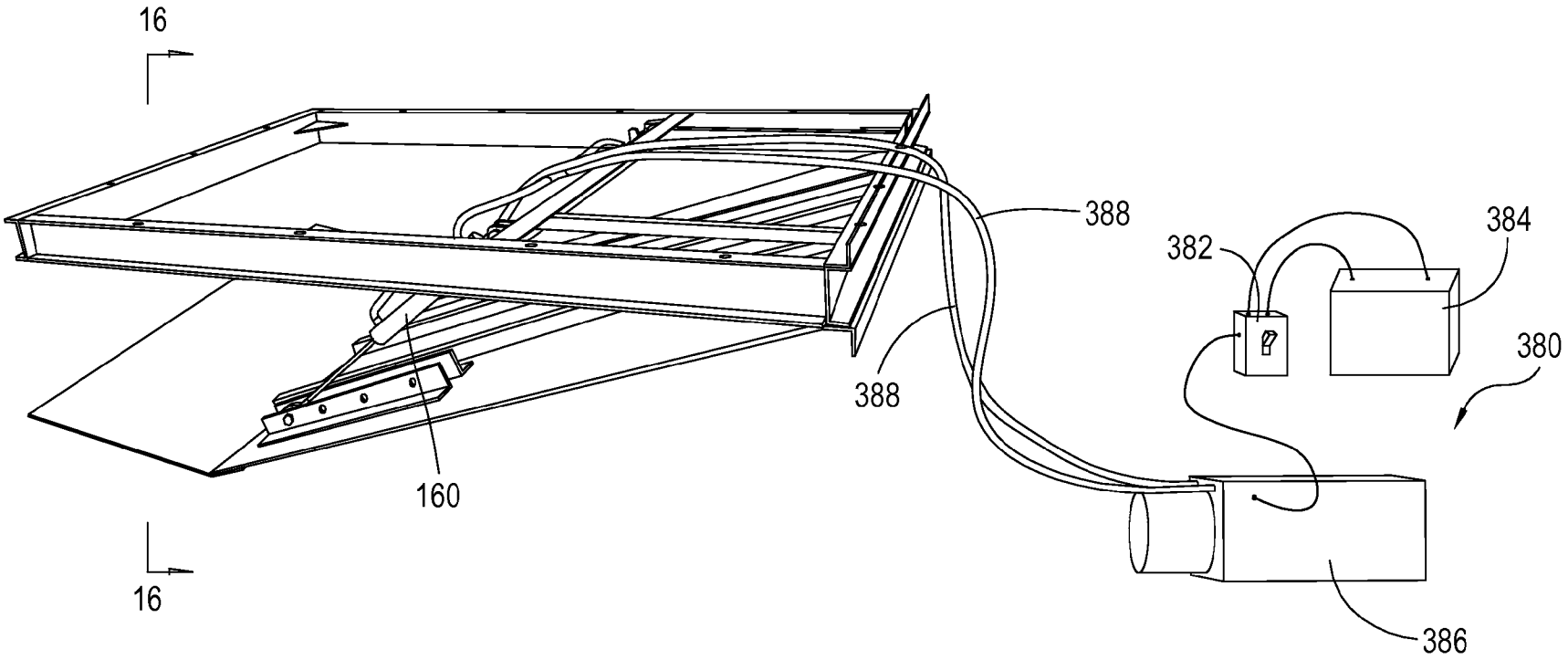
FIG. 14 is one embodiment of a hydraulic power system for any of the adjustable planing devices from FIGS. 1-13.
Figure 15:
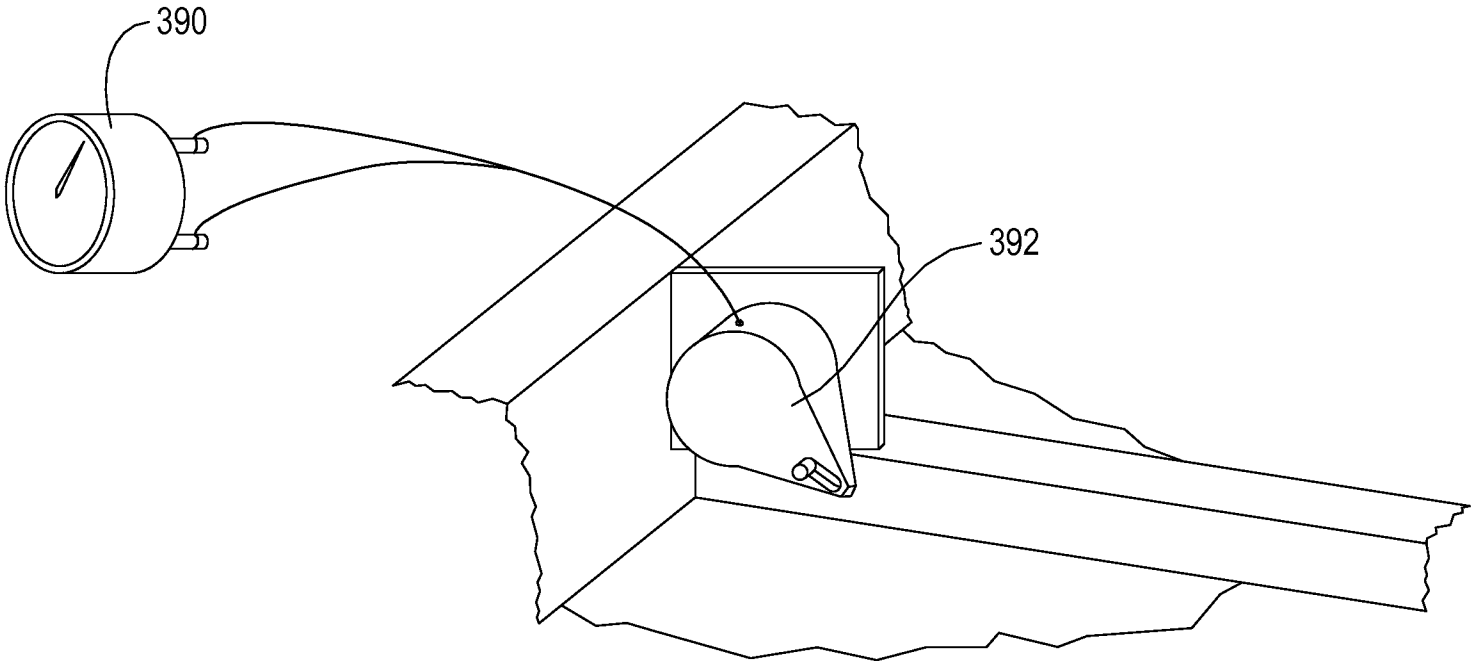
FIG. 15 is one embodiment of a trim gauge for any of the adjustable planing devices from FIGS. 1-13.
Figure 16:
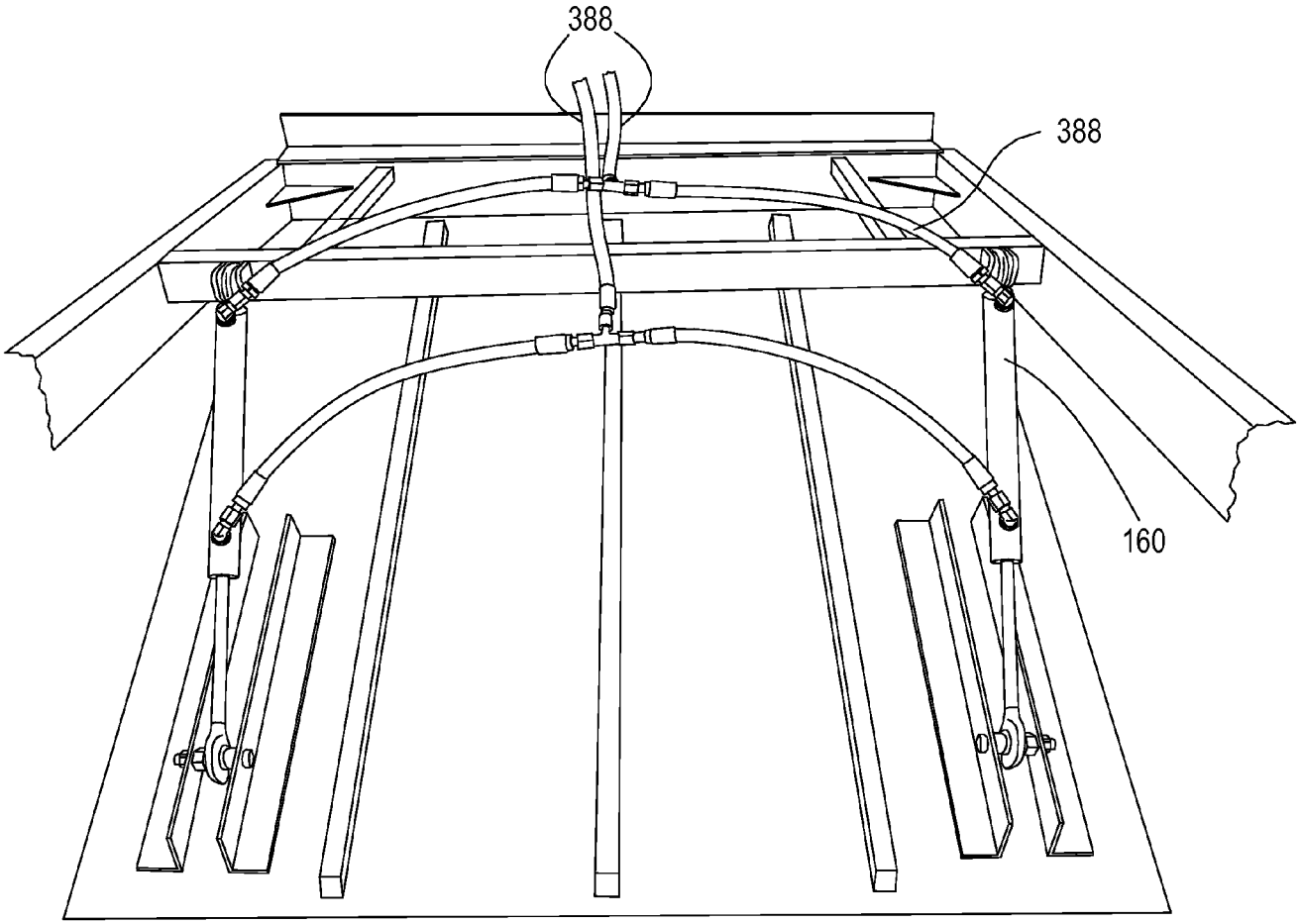
FIG. 16 is a side view of the embodiment from FIG. 14.

One embodiment of a power system 380 for any of the adjustable planing devices 100, 200, and 300, from FIGS. 1-13, and the adjustable planing device 400 from FIGS. 17-24, is illustrated in FIGS. 14-16. Although the power system 380 is illustrated adjacent the planing device 200, some of the members of the power system 380 are typically mounted in the console dash or seat storage compartments of a boat for easy access by a boat operator when the planing device 200 is attached to a pontoon boat. One embodiment of the power system 380 includes a three way or toggle switch device 382, a battery 384, a power pump 386, and one or more hoses 388 for connection to the hydraulic cylinders 160. The power system 380 provides oil to the hydraulic cylinders 160 so the hydraulic cylinders 160 can be extended or retracted. The three way switch 382 operates in three positions, up, neutral, and down, to control the direction of the planing plate 140. In one form, the three way switch 382 is mounted on the dash of the boat to actuate the hydraulic cylinders 160. In one embodiment, the battery 384 is a 12 volt battery. When the three way switch 382 is not actuated, the power pump 386 has an internal check valve to keep the oil trapped in the hydraulic cylinders 160 so the hydraulic cylinders 160 cannot extend or retract. For additional safety, remote or integral pilot operated check valves can be incorporated into the power system 380. A crossover relief valve can be added to allow oil to transfer from the rod side to the piston side of the hydraulic cylinders 160. This will provide an action much like a shock absorber in the event that the planing plate 140 or planing device 440 strikes an underwater object to help prevent damage to the adjustable planing device 100. In one embodiment, the hydraulic oil used in the power system 380 is a food grade type so that in the event there is a hydraulic oil leak, there is no damage to the environment. Beneficially, this type of connection makes the planing devices described above a green machine or environmentally friendly machine. In an alternate embodiment, the power system 380 includes a gauge 390 connected with a sensor 392 to indicate the optimum position of the planing plate 140 or a buoyant planing device 440 based on different loads or weight of the passengers, gear, and other contents of the pontoon boat. The sensor 392 is typically mounted on either the planing plate 140 or the buoyant planing device 440 and provides the angle of plate 140 or planing device 440 from horizontal with water to a lowered position. Typically, the gauge 390 is mounted in the operator's control panel of the pontoon boat.

A fourth embodiment of an adjustable planing device 400 is illustrated in FIGS. 17-24 wherein the adjustable planing device 400 is attached to a pontoon boat as described in more detail below. More specifically, the pontoon boat has a midship region that spans between a front end and a rear end. In the illustrated embodiment, the adjustable planing device 400 includes a modular frame 420 and a planing device 440. The adjustable planing device 400 is similar to the adjustable planing device 100 described above; therefore, for the sake of brevity similar details will not be repeated herein.

Figure 17:
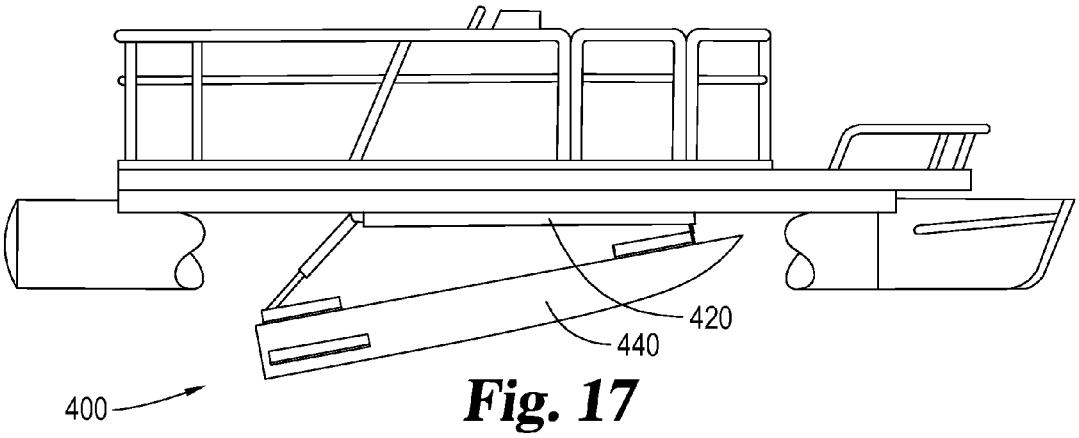
FIG. 17 is a cross-sectional view of another embodiment of an adjustable planing device mounted to a pontoon boat.
Figure 18:
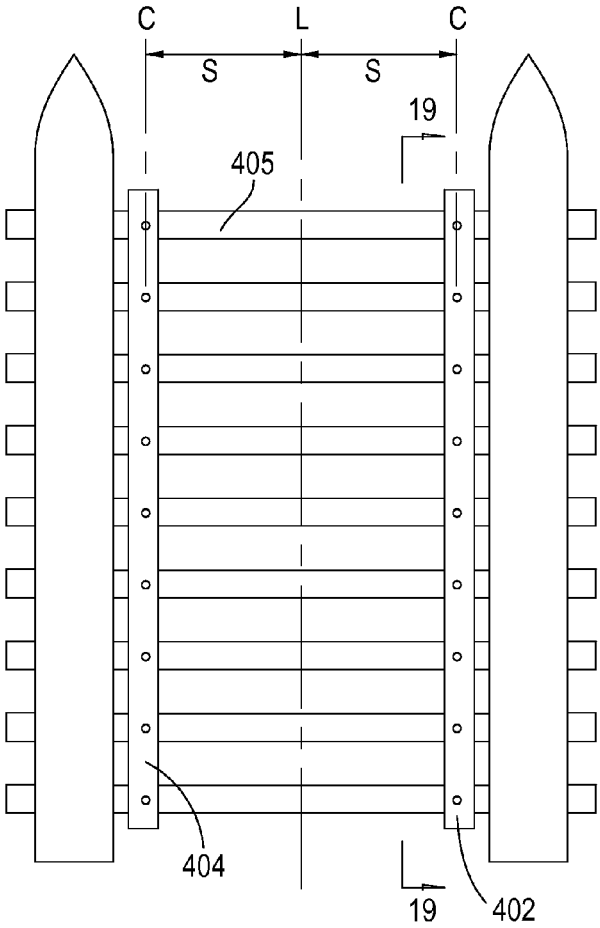
FIG. 18 is a bottom view of the pontoon boat with a first and a second mounting rail attached to cross-members of the pontoon boat of the FIG. 17 embodiment.
Figure 19:
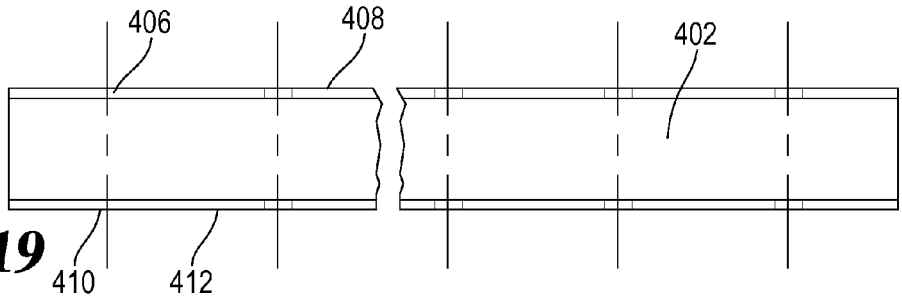
FIG. 19 is a side view of the first mounting rail of the FIG. 18 embodiment.

In FIGS. 17 and 18, adjustable planing device 400 includes a track mountable to the bottom of a pontoon boat or bottom of cross-members of a pontoon boat wherein the planing device 440 is selectively movable along the track forward and aft with respect to the boat. One illustrated embodiment of the track includes a first mounting rail 402 and a second mounting rail 404 attached to cross-members 405 of the pontoon boat. The first and the second mounting rails 402 and 404, respectively, are each spaced a horizontal distance S from a longitudinal axis L of the pontoon boat. The distance S is measured from the longitudinal axis L to a centerline C of either the first mounting rail 402 or the second mounting rail 404. The total combined distances S of both the first and the second mounting rails 402 and 404 correspond to a width of the modular frame 420 or the distance between a right member and a left member of the modular frame 420. As such, the first mounting rail 402 is configured to receive a right member of the modular frame 420 and similarly the second mounting rail 404 is configured to receive a left member of the modular frame 420 to retain the modular frame 420 between the first and the second mounting rails 402 and 404, respectively. The total combined distances S also typically include a clearance distance that ranges from 0 inches to about 0.25 inches to provide extra space for the right and the left members of the modular frame 420. The longitudinal position of the modular frame 420 along the longitudinal axis L of the pontoon boat is adjustable by sliding the modular frame 420 along or within the first and the second mounting rails 402 and 404, respectively, which is done either manually or automatically such as with a linear actuator or other means as described below. The variable longitudinal position of the modular frame 420 enables a pontoon boat operator to determine the best location of the planing device 440 that during use of the boat will increase the speed of the pontoon boat, provide a better, smoother ride for passengers of the boat, and better or increased fuel economy of the pontoon boat. After a preferred position of the modular frame 420 and planing device 440 is determined, then the modular frame 420 is locked relative to the first and the second mounting rails 402 and 404. As such, the modular frame 420 is no longer moveable relative to the first and the second mounting rails 402 and 404. Various locking mechanisms can be used to limit or stop movement of the modular frame 420 relative to the first and the second mounting rails 402 and 404 as described below.

In the illustrated embodiment, the first and the second mounting rails 402 and 404, respectively, have a C or channel cross-sectional shape; however, other embodiments can include a different cross-sectional shape as long as the first and the second mounting rails 402 and 404, respectively, retain the right and the left members of the modular frame 420 therein. In one embodiment, the first and the second mounting rails 402 and 404 have a top flange width and a bottom flange width of about 2.5 inches, a height of about 5 inches, and a thickness of about 0.25 inch. The first and the second mounting rails 402 and 404 are positioned such that the open side of the channel shape will face each other. In some embodiments, the inside surface of the first and the second mounting rails 402 and 404 is coated with a friction reducing lubricant or coating or nylon-rubber material pads placed on the first and second mounting rails 402 and 404 to prevent metal-to-metal contact between the first and the second mounting rails 402 and 404 and the right and left members of the modular frame 420. The first and the second mounting rails 402 and 404, respectively, are attached to the cross-members 405 of the pontoon boat such as by welds, bolts, screws, pins, or other fastener means.

In the illustrated embodiment, the first and the second mounting rails 402 and 404, respectively, each have a plurality of holes 406 that span along the centerline C of a top flange 408 and a plurality of holes 410 that span along the centerline C of a bottom flange 412. The first and the second mounting rails 402 and 404 attach to the cross-members 405 via the plurality of holes 406 that span along the centerline C of the top flange 408. The right and the left members of the modular frame 420 each have a plurality of holes 427 along a bottom flange that correspond with the plurality of holes 410 of the first and the second mounting rails 402 and 404 such that one or more of holes 410 and one or more of holes 427 align to receive a fastener to connect the right and the left members of the modular frame 420 to the first and the second mounting rails 402 and 404, respectively. Some types of fasteners include bolts, screws, pins, or other mechanical means can be used to attach the first and the second mounting rails 402 and 404 to the cross-members 405 and the modular frame 420 to the first and the second mounting rails 402 and 404 to limit or stop movement of the modular frame 420 relative to the first and the second mounting rails 402 and 404.

Optionally, some embodiments include a first connector bar or threaded rod attached to the front ends of the first mounting rail 402 and the second mounting rail 404 and a second connector bar or threaded rod attached to the rear ends of the first mounting rail 402 and the second mounting rail 404 to provide additional strength and to tie or connect the first mounting rail 402 and the second mounting rail 404 together for more structural support. For example, a first connector bar includes a 2 inch square tube that is bolted to the front ends of the first mounting rail 402 and the second mounting rail 404. The 2 inch square tube has caps welded on each end with one or more holes drilled in the tube so the tube can be bolted to the first mounting rail 402 and the second mounting rail 404. Similarly, a second connector bar includes a 2 inch square tube can be bolted to the rear ends of the first mounting rail 402 and the second mounting rail 404 in the same manner as the first connector bar.

Alternatively, the track can be a single longitudinal element and the planing device 440 is selectively movable along the single longitudinal element to selectively adjust the longitudinal position of the planing device 440 forward and aft with respect to the boat. For example, the single longitudinal element is mounted along a longitudinal centerline of the pontoon boat on the bottoms of the cross-members. The planing device 440 is configured to attach to the single longitudinal element in a manner that allows the planing device 440 to move along the single longitudinal element forward and aft with respect to the boat. As another example, the single longitudinal element can be an I-shaped or T-shaped bean and the planing device 440 includes an attachment mechanism to engage and retain itself with the single longitudinal element to move forward and aft with respect to the boat.

Figure 20:
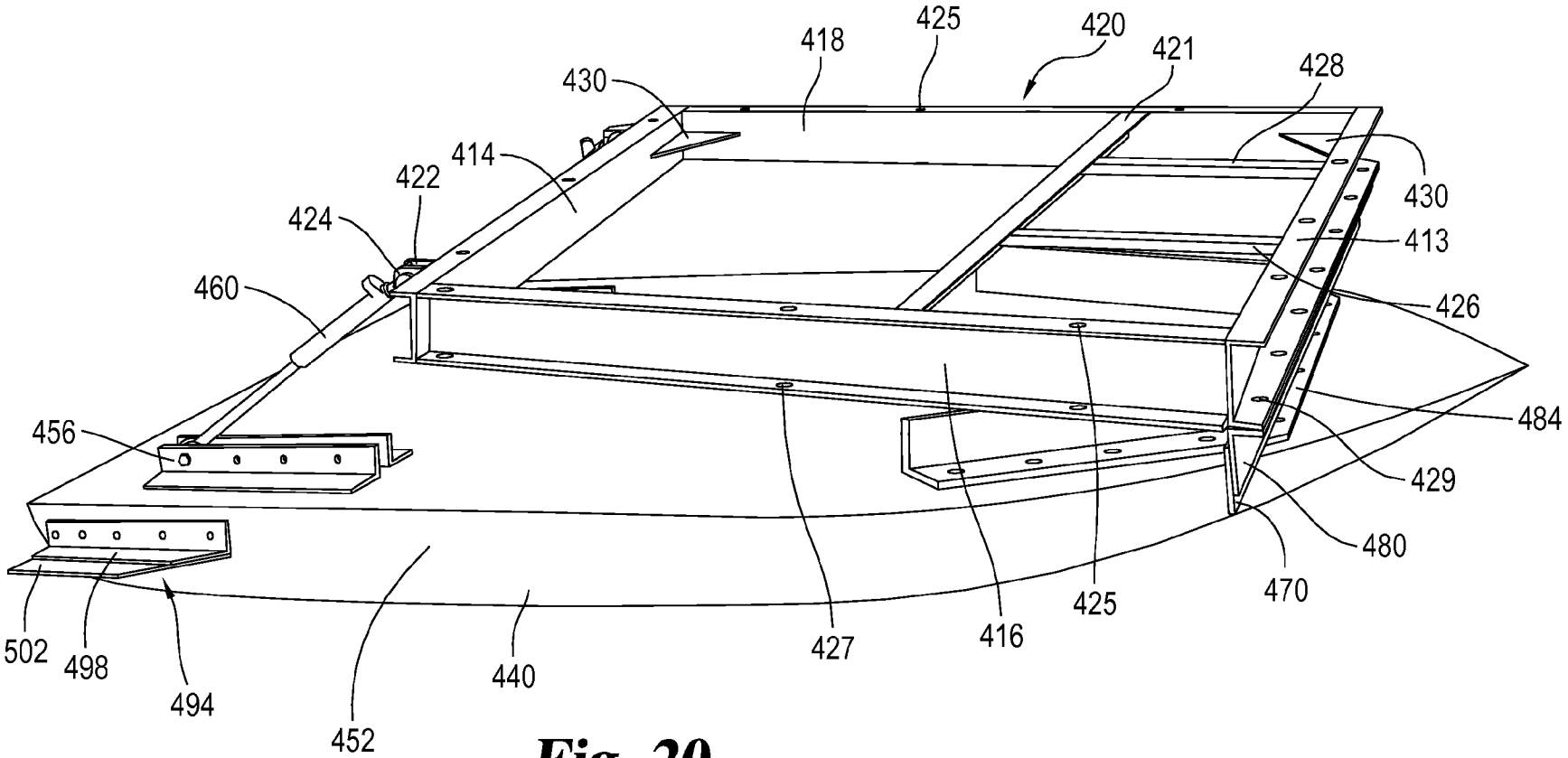
FIG. 20 is a top perspective view of the adjustable planing device of the FIG. 17 embodiment.

As illustrated in FIG. 20, the modular frame 420 is similar to the modular frame 110 and is configured to attach to the midship region of the pontoon boat. As such, the modular frame 420 has a front member 413 opposite a rear member 414 and a right member 416 opposite a left member 418 wherein the right and the left members 416 and 418 span between the front member 413 and the rear member 414. In this embodiment, the modular frame 420 includes a cross-member 421 that spans between the right and the left members 416 and 418, respectively. In other embodiments, the modular frame 420 includes additional cross-members 421 that span between the right and the left members 416 and 418. In some embodiments, the length of each of the right and the left members 416 and 418 and the length of each of the front and the rear members 413 and 414 is sized to accommodate a particular sized pontoon boat. In the illustrated embodiment, the right and left members 416 and 418 and the front and the rear members 413 and 414 have a channel or C cross-sectional shape. However, other embodiments can include different cross-sectional shapes such as, but not limited to, L-shaped angles, I-beams, tubes, and/or rectangular shapes.

The rear member 414 includes a pair of mounting plates 422 configured for attachment of a hydraulic cylinder, powered actuator, or other mechanism that is configured to move the planing device 440. As described below, the hydraulic cylinder or other mechanism is also attached to the planing device 440. In this embodiment, each of the mounting plates 422 includes a hole 424 sized to receive a bolt or other mechanical device to attach the hydraulic cylinder thereto. Although the hydraulic cylinders are illustrated attached to the rear member 414, other embodiments can attach the hydraulic cylinders to the cross-member 421 or the front member 413.

In one embodiment, the right member 416 and the left member 418 include a plurality of holes 425 along a top flange to attach the modular frame 420 to cross-members 405 of the pontoon boat. In a second embodiment, the right member 416 and the left member 418 include a plurality of holes 427 along a bottom flange sized to receive a bolt or other mechanical fastener to connect the corresponding member of the modular frame 420 to the first and the second mounting rails 402 and 404. The plurality of holes 427 enables the optimum position of the modular frame 420 to be located relative to the longitudinal axis L of the pontoon boat and along the first and the second mounting rails 402 and 404 and, in one particular embodiment, the modular frame 420 is positioned in the midship region of the pontoon boat. Moreover, the plurality of holes 427 enables a single adjustable planing device 400 along with first and second mounting rails 402 and 404 to be used with any one of differently sized pontoon boats. The front member 413 also includes a plurality of holes 429 along a bottom flange to receive a bolt, pin, or other mechanical device to connect a vertical member of the buoyant planing device 440.

In the illustrated embodiment, the modular frame 420 includes a first longitudinal stiffener 426 that spans between the front member 413 and the cross-member 421. In this form, the modular frame 420 also includes a second longitudinal stiffener 428 that spans between the front member 413 and the cross-member 421. In other embodiments the modular frame 420 includes additional longitudinal stiffeners that span between the front member 413 and the cross-member 421, the cross-member 421 and the rear member 414, or the front member 413 and the rear member 414. Alternatively, the modular frame 420 may not include any longitudinal stiffeners in other embodiments.

The modular frame 420 includes a stiffener plate 430 that is mounted at each of the joints between the right and the left members 416 and 418 and the front and the rear members 413 and 414. As such, the stiffener plate 430 is mounted at the joint between the right member 416 and the front member 413 and another of the stiffener plate 430 is mounted at the joint between the right member 416 and the rear member 414. Correspondingly, although not illustrated in FIG. 21, the modular frame 420 includes a third stiffener plate 430 mounted at the joint between the left member 418 and the front member 413 and a fourth stiffener plate 430 mounted at the joint between the left member 418 and the rear member 414. The stiffener plate 430 has a flat triangular shape; however, other embodiments can include an L-shape, a tube shape, a channel, or other shapes that are configured to reinforce the joint between two members. Other embodiments of the modular frame 420 may not include any stiffener plates.

The modular frame 420 can be made from various materials combinations of materials, such as, metal, aluminum, steel, plastic, and fiberglass, to name a few.

Figure 21:
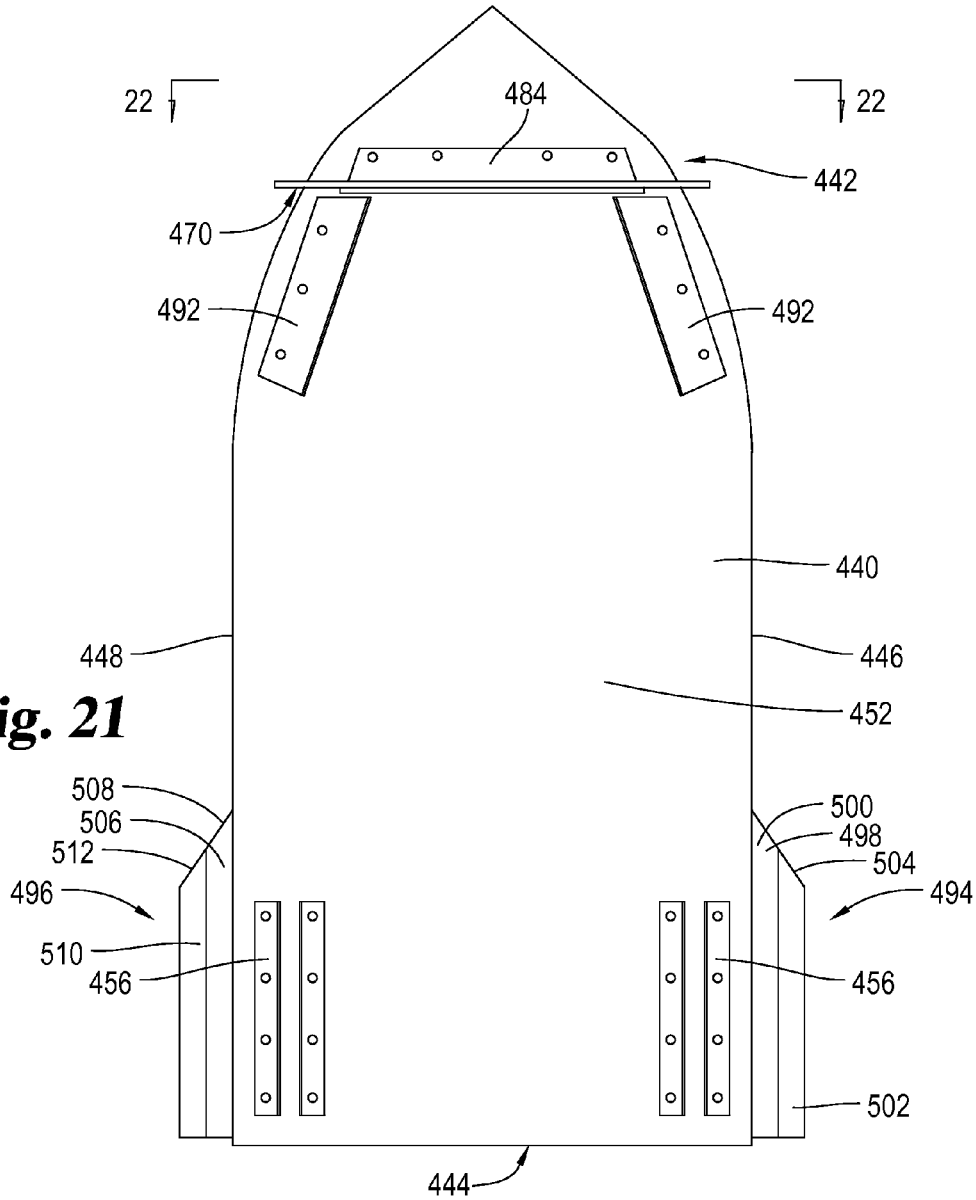
FIG. 21 is a top view of the buoyant planing device of the FIG. 17 embodiment.
Figure 22:
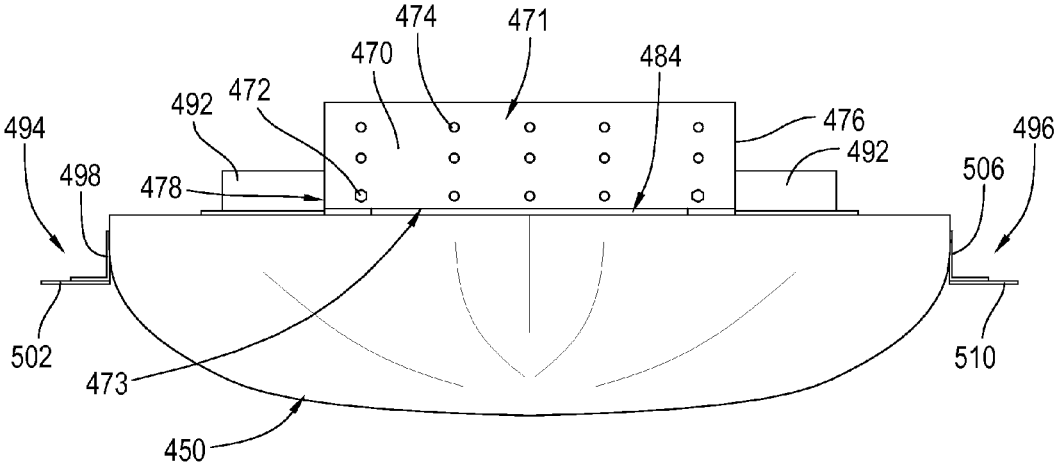
FIG. 22 is a front view of the adjustable planing device from FIG. 21.
Figure 23:
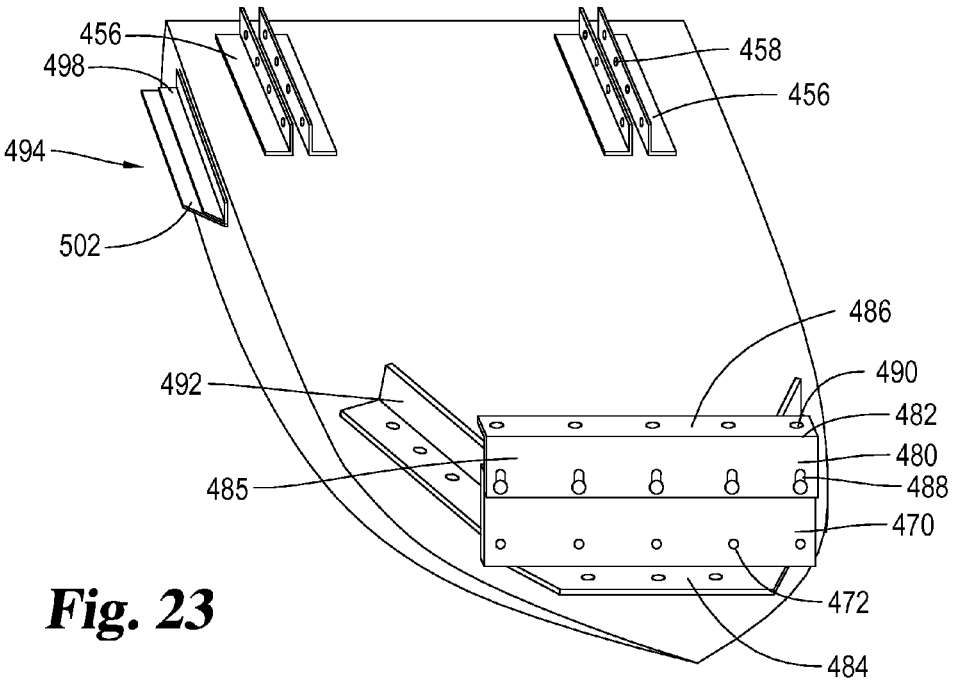
FIG. 23 is a front perspective view of the adjustable planing device from FIG. 21 with a connector member attached.

As illustrated on FIGS. 21, 22, and 23, the planing device 440 has a front end portion 442 opposite a rear end portion 444, a right side 446 opposite a left side 448, wherein the right and the left sides 446 and 448, respectively, span between the front end portion 442 and the rear end portion 444. The planing device 440 has a depth and cross-sectional shape that vary from the front end portion 442 to the rear end portion 444. Some example cross-sectional shapes of the front end portion 442 include flat, vee, semi-vee, tri-hull, rounded vee, deep rounded vee, straight vee, triangular, and other tapered cross-sectional shapes. The tapered cross-sectional shape of the front end portion 442 improves steering and handling, increases the speed, and improves the fuel mileage of the pontoon boat. Some example cross-sectional shapes of the rear end portion 444 include flat, semi-circular, flat-bottomed, rectangular, and other semi-triangular cross-sectional shapes that provide a larger surface area to create additional lift. The planing device 440 has a shape, length, and width that can be made to accommodate different size pontoon boats. The planing device 440 also includes a lower face 450 opposite an upper face 452 wherein the lower and the upper faces 450 and 452 span between the front end portion 442 and the rear end portion 444. The lower face 450 has a substantially smooth surface to engage the waterline when the pontoon boat is in the water. In one embodiment, the planing device 440 is buoyant wherein due to the increased buoyancy from the planing device 440 the pontoons will ride higher in the water, resulting in less drag and friction on the pontoons. As such, at least a portion of the buoyant planing device 440 comprises a subsurface volume below water level wherein the subsurface volume has an average density less than a one kilogram per liter density of water. In an alternative embodiment, an opening or cavity is formed in the upper face 452 of the planing device 440. The opening or internal cavity can extend a portion or almost the full depth of the planing device 440 and extend all or most of the length of the planing device 440.

The planing device 440 can be a welded assembly, formed by a hydraulic press, or molded to form a unique shape as described above. The planing device 440 can be made of various materials, such as, metal, aluminum, steel, plastic, carbon fiber, and fiberglass, or a combination of materials. In one embodiment, the planing device 440 is a molded plastic unit that is foam filled and sealed. Optionally, the planing device 440 can be covered with a metal skin such as aluminum, steel, fiberglass, or other materials that cover the lower and the upper faces 450 and 452 to also make the planing device 440 watertight, sealed, and floatable in water and ultimately increase buoyancy of the pontoon boat. In one embodiment, the planing device 440 includes cross-members that are added to the planing device 440. For example, additional plating, brackets, or struts are added to either an internal cavity or upper planing surface 452 to strengthen the planing device 440.

The planing device 440 includes a mounting mechanism for attachment of a hydraulic cylinder or powered actuator 460. In one embodiment, the mounting mechanism is monolithic with the planing device 440 and is configured for attachment with the powered actuator 460. Examples of a monolithic mounting mechanism include a bracket or clip-like configuration that is formed with and part of the planing device 440 to attach the powered actuator 440 thereto. One example of a mounting mechanism includes two pairs of mounting members 456 spaced apart from one another on the upper face 452 towards the midship area of the planing device 440 or the rear end portion 444. The pairs of mounting members 456 include one or more holes 458 for mounting one end of a powered actuator or a hydraulic cylinder 460 between a pair of the mounting members 456. Hydraulic cylinder 460 is similar to hydraulic cylinder 160 described above. The hydraulic cylinder 460 operates to rotate the planing device 440 to enable the rear end portion 444 to further engage the waterline at various depths in the water for optimum planing of the pontoon boat. As such, the elevation of the rear end portion 444 of the planing device 440 is adjustable as different loads and weather conditions can be accommodated. This eliminates or minimizes splash over the front end of the pontoon boat and provides for a more comfortable ride for the passengers. Other embodiments can include an alternative configuration for attaching the hydraulic cylinder 460 or other mechanical device to the mounting members 456. In the illustrated embodiment, the mounting members 456 are L-shaped but can include other shapes such as channels or I beams. As can be appreciated, the hydraulic cylinders 460 can be mounted either vertical from the modular frame 420 or using a linkage arrangement which can be fabricated to allow the hydraulic cylinder 460 to be mounted in other positions. In the illustrated embodiment the hydraulic cylinders 460 are attached to the mounting members 456 and the rear member 414; however, in other embodiments the hydraulic cylinders 460 are attached to the cross-member 421.

The planing device 440 includes a vertical member 470 that enables the vertical position of the planing device 440 to be selectively adjusted. Another benefit of the vertical member 470 and the powered actuator 460 is that the planing device 440 and the vertical member 470 are selectively movable together vertically up and down with respect to the boat to vary how deep into the water the powered actuator moves the planing device 440 downwardly into the water. Vertical member 470 is attached to the upper face 452 near the front end portion 442 of the planing device 440. The vertical member 470 has a top end 471 opposite a bottom end 473, and a right side 476 opposite a left side 478 and a length that spans between the right and left sides 476 and 478. The vertical member 470 can have various sizes and shapes but in one embodiment, the vertical member 470 is a plate that is ⅜ inch thick, 6 inches high, and 24 inches long. In one embodiment, the bottom end 473 of the vertical member 470 is welded and attached to the upper face 452. Other embodiments include the vertical member 470 being monolithic with the upper face 452. In alternative embodiments, the vertical member 470 is attached to the cross-member 421 of the pontoon boat and the planing device 440 is selectively adjustable vertically relative to the pontoon boat. In the illustrated embodiment, the planing device 440 includes a mounting bracket 484 configured to receive the vertical member 470 wherein the mounting bracket 484 is attached to the upper face 452. One embodiment of the mounting bracket 484 has an L or angle shape that is 0.25 inch thick, 2 inch first leg, 2 inch second leg, and 12 inch length. In this form, the mounting bracket 484 includes a plurality of holes (not illustrated) that align with a plurality of holes 472 near the bottom end 473 in the vertical member 470 to receive a fastener such as a bolt, screw, pin, or other device to attach the vertical member 470 to the mounting bracket 484. The plurality of holes 472 have a diameter that range from about 0.25 inch to about 1 inch. Other sizes, dimensions, configurations, or shapes of mounting bracket 484 are possible in other embodiments. In yet other alternative embodiments, the upper face 452 includes a monolithic structure that is formed with the planing device 440 wherein the monolithic structure is in the shape of a bracket or attachment mechanism to attach the vertical member 470 directly to the planing device 440.

The vertical member 470 includes a set of connecting features 474 near the top end 471 that are configured to connect with a set of connecting features 488 on a connector member 480 to attach the planing device 440 to the modular frame 420 at a desired vertical position of the planing device 440 relative to the pontoon boat. In the illustrated embodiment, the set of connecting features 474 are a plurality of holes sized to receive a fastener such as a bolt, screw, pin, or other device to attach the vertical member 470 to the connector member 480 as described below. For example the set of connecting features 474 can be a plurality of holes having a ½ inch mounting diameter. The set of connecting features 474 allow up and down movement of the connector member 480 so the vertical position of the planing device 440 can be adjusted. Other embodiments of the set of connecting features 474 include alternative configurations of attaching the connector member 480 to the vertical member 470 in a manner that allows adjustability of the vertical position of the planing device 440 relative to the pontoon boat.

The connector member 480 includes a rotation mechanism such as a hinge 482 that connects a first member 485 to a second member 486. The hinge 482 enables the planing device 440 to rotate downward to a lowered position. The planing device 440 has a lowered position wherein the rear end portion 444 of the planing device 440 is lower than the modular frame 420 or the pontoon boat anywhere from a minimum of about 3 inches to a maximum of about 17 inches. The connector member 480 has a length sufficient to attach and connect with the front member 413 of the modular frame 420 as illustrated or with a cross-member 421 of the pontoon boat in an alternative embodiment. The first member 485 has a length sufficient to connect with the vertical member 470. In the illustrated embodiment, the first member 485 is the same length as the vertical member 470. The first member 485 has a set of connecting features 488 that span along the length and are configured to connect with the set of connecting features 474 from the vertical member 470. In the illustrated embodiment, the set of connecting features 488 are each a slot with an elongated oval shape to align with the set of connecting features 474 that have a round shape to receive a fastener to connect the vertical member 470 to the connector member 480. In the illustrated embodiment, the set of connecting features 488 in the shape of a slot enable the vertical adjustment of the vertical member 470 and the planing device 440 of about 1 inch to about 6 inches relative to the first member 485. In an alternate embodiment, the set of connecting features 488 are round holes and the set of connecting features 474 are slots having an elongate oval shape. In yet another embodiment, the two sets of connecting features 474 and 488 are configured to lock together to maintain the planing device 440 in a fixed orientation and then to unlock to selectively adjust the vertical position of the planing device 440 relative to the modular frame 420 or pontoon boat as needed. Mechanical fasteners may not be needed in some embodiments to lock the two sets of connecting features 474 and 488 together as the sets of connecting features 474 and 488 may be interactive and self-locking. The second member 486 has a length that corresponds to the length of the front member 413 of the modular frame 420. In the illustrated embodiment, the hinge 482 and the second member 486 are about the same length as the front member 413 of the modular frame 420. For example, in one embodiment, the hinge 482, the second member 486, and the front member 413 each have a length of about 24 inches; however, in other embodiments these members can be longer or shorter than 24 inches. The second member 486 includes a plurality of holes 490 that align with the plurality of holes 429 in the front member 413 to receive a fastener to attach the planing device 440 to the modular frame 420. The plurality of holes 490 have a diameter that ranges from about 0.25 inch to about 1 inch.

Optionally the planing device 440 includes additional mounting brackets 492 attached to the upper face 452 wherein each of the mounting brackets 492 is adjacent to the mounting bracket 484. The mounting brackets 492 are attached to the upper face 452 in a similar manner as mounting bracket 484 or mounting brackets 492 could be monolithic with upper face 452. Alternatively, the planing device 440 includes monolithic mounting mechanisms configured as a bracket, clip, loop, or other protrusion that receive the attachment or safety mechanism, powered actuators, or other devices. Mounting brackets 492 can be configured to receive attachment or safety mechanisms, powered actuators, or strengthen the upper face 452.

Optionally the planing device 440 includes a first sponson 494 attached to the right side 446 of the planing device 440 and a second sponson 496 attached to the left side 478 of the planing device 440. In one form, the first sponson 494 and the second sponson 496 are monolithic with the planing device 440 and formed as part of the planing device 440. The first and the second sponsons 494 and 496 are mounted at or near the waterline level when the planing device 440 is assembled with a pontoon boat. The first and the second sponsons 494 and 496 are configured to contact the waterline when the planing device 440 is in the lowered position to provide additional surface area to lift the pontoon boat. The first sponson 494 is similar to the second sponson 496 wherein each sponson includes a mounting portion that attaches to and is flush with either the right or left sides 446 or 478 of the planing device 440. The first and the second sponsons 494 and 496 also include a horizontal planing surface that extends away from the right and left sides 446 and 478 of planing device 440. Moreover, the horizontal planing surface of the first and second sponsons 494 and 496 is also configured to contact the water surface when the planing device 440 is in a lowered position to provide additional surface area to lift the pontoon boat. The length of the first and the second sponsons 494 and 496 is determined by the length of the pontoon boat such that a longer boat requires a sponson having a longer length than a shorter boat and corresponding sponson. The first and the second sponsons 494 and 496 can include a different configuration and shape that attaches to the planing device 440 and provides additional surface area to contact the water surface.

One embodiment is illustrated in FIGS. 21-23 wherein the first sponson 494 includes the mounting portion that includes a mounting bracket 498 that is welded, fastened, or otherwise attached to the right side 446 of the planing device 440. Similarly, the second sponson 496 also includes a mounting bracket 506. The mounting brackets 498 and 506 are formed from an angle or L cross-sectional shape. In one embodiment, the mounting brackets 498 and 506 are an L cross-sectional shape with a 0.25 inch thickness, 2 inch first leg, 2 inch second leg, and 24 inch length. However in other embodiments, the mounting brackets 498 and 506 are sized differently. As illustrated a front edge 500 of the mounting bracket 498 is tapered such that the front edge 500 forms an angle with the right side 446 of the planing device 440. Similarly a front edge 508 of the mounting bracket 506 is tapered such that the front edge 508 forms an angle with the left side 478 of the planing device 440. Attached to the mounting bracket 498 is a planing surface in the form of a horizontal plate 502 that has a front edge 504 that is tapered to typically match the taper of the front edge 500 when the horizontal plate 502 is attached to the mounting bracket 498. Attached to the mounting bracket 506 is a horizontal planing surface in the form of a horizontal plate 510 that has a front edge 512 that is tapered to typically match the taper of the front edge 508 when the horizontal plate 510 is attached to the mounting bracket 506. The horizontal plates 502 and 510 increase the surface area of the planing device 440 in a lowered position. In other embodiments, the horizontal plates 502 and 510 are not used and instead the mounting brackets 498 and 506 are configured differently to engage more of the water surface such as with wider and/or longer planing surfaces. The first and second sponsons 494 and 496 are made of steel, aluminum, metal, plastic, fiberglass, or a combination of these materials.

Optionally the adjustable planing device 400 includes a drive assembly 600 attached to the midship region and in particular a cross-member 405 of the pontoon boat wherein the drive assembly 600 is configured to move the modular frame 420 and the planing device 440 along the track or the first and the second mounting rails 402 and 404. In other embodiments, the adjustable planing device 400 does not include the drive assembly 600 and is instead manually moved along the first and the second mounting rails 402 and 404.

Figure 24:
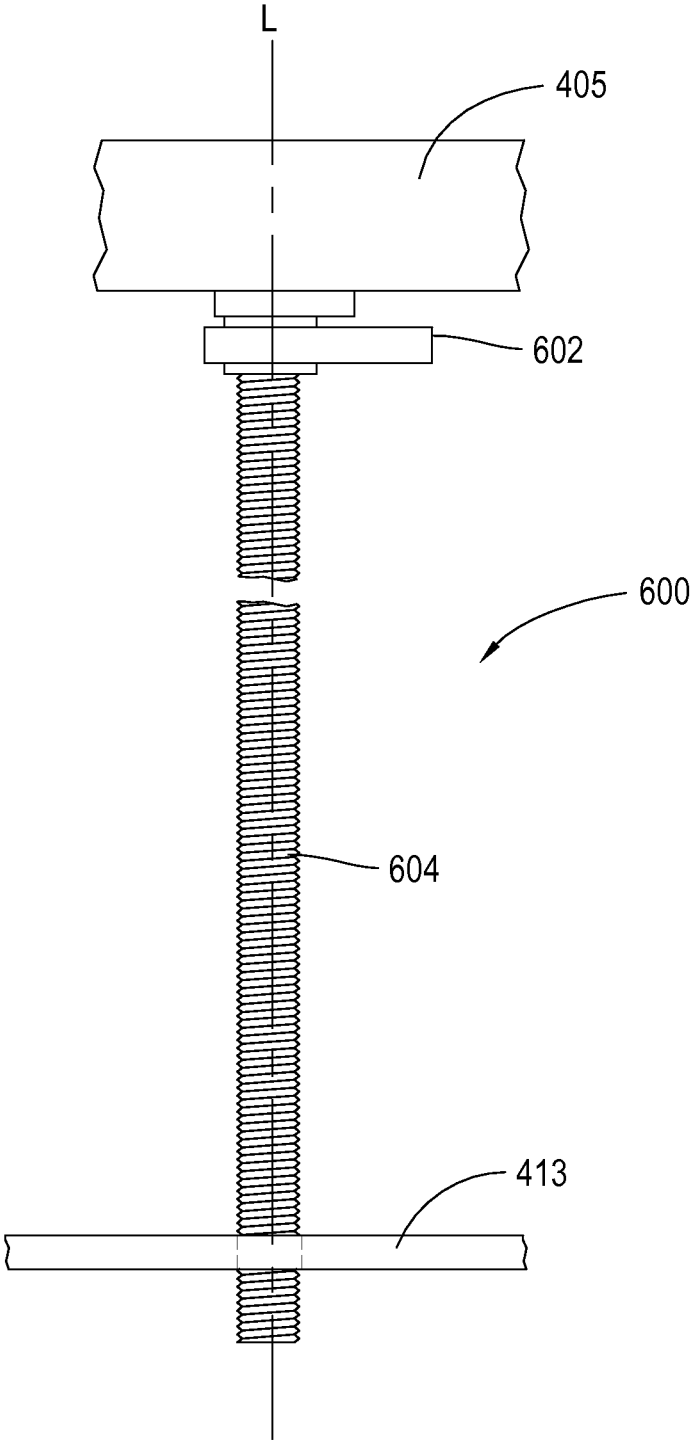
FIG. 24 is a top view of an embodiment of a drive assembly for use with the FIG. 17 embodiment.

One embodiment of the drive assembly 600 is illustrated in FIG. 24; however, in other embodiments the drive assembly 600 can include different mechanisms to move the modular frame 420 and the planing device 440. The drive assembly 600 enables remote control of the adjustable planing device 400 along the longitudinal axis of the pontoon boat to allow the boat operator to find the sweet spot for the planing device 400 in relation to the pontoon boat and to the water surface to provide optimum speed, ride, and fuel economy. The drive assembly 600 is mounted along the longitudinal axis L of the pontoon boat; however, other embodiments can include two or more drive assemblies 600 wherein the drive assemblies 600 can be spaced apart from each other or adjacent one another. The drive assembly 600 includes a drive unit 602 mounted on the cross-member 405. The drive assembly 600 also includes a rotatable threaded part 604 operatively connected to the drive unit 602 and attached to the front member 413 of the modular frame 420. Rotation of the threaded part 604 by the drive unit 602 moves the modular frame 420 and the attached planing device 440 forward or rearward along the first and the second mounting rails 402 and 404. In one form, the drive unit 602 is a 12 volt D.C. motor and the threaded part 604 is a worm gear assembly such that together these parts provide horizontal movement of the planing device 440. A toggle switch mounted on the boat operator's console allows fore and aft movement of the planing device 400. In some embodiments, the modular frame 420 is moved between 1 inch and 36 inches; however, the distance the modular frame 420 is moved is dependent on the length of the threaded part 604 and the length of the first and the second mounting rails 402 and 404. Manual locking mechanisms can be incorporated as a safety feature to prevent movement of the planing device 400 and protection of the drive assembly 600. The manual locks would support the force and weight of the planing device 400 and be a backup to hold the planning device 400 in position in the event the drive assembly 600 failed. Other types of drive assemblies 600 can be used such as hydraulic, electric over hydraulic, full hydraulic, a hydraulic pump, valves and hydraulic system, and various rack and pinion units.

In one embodiment, the planing device 440 is hollow and includes a pump such as a bilge pump to remove water from within the buoyant planing device 440. A cover on the upper face 452 allows access to the interior of the planing device 440 and the pump therein. Electrical wires pass through the upper face 452 to the pump and connect to the battery 384 to operate the pump. An outlet hose is ported outside the planning device 440 through either the right or the left sides 446 or 448.

In an optional embodiment, the adjustable planing device 400 includes a safety device to ensure that the planing device 440 is retained with the pontoon boat in the event of a catastrophic failure of the hinge 482, the connection between the sets of connecting features 488 and 474 of the connector member 480 and the vertical member 470, and/or the connection between the connector member 480 and the front member 413 of the modular frame 420. For example, one or more safety restraining cables attach to the front end portion 442 of the planing device 440 and one of the modular frame 420, first and second mounting rails 402 and 404, and/or the cross-members 405 of the pontoon boat. Another safety device for the adjustable planing device 400 includes a pair of safety slings that attach to the front end portion 442 of the planing device 440 and either the modular frame 420 or the first and second mounting rails 402 and 404. The safety restraining cables and/or slings would prevent the planing device 440 from exiting out the back or rear end of the boat which could destroy or seriously damage the outboard motor in the situation that there is a catastrophic failure of any of the hinge 482, the connection between the sets of connecting features 488 and 474 of the connector member 480 and the vertical member 470, and/or the connection between the connector member 480 and the front member 413 of the modular frame 420.

The adjustable planing device 400 can be sold in a kit form and attached to a pre-existing pontoon boat, the adjustable planing device 400 can be sold as an aftermarket product for pontoons in the field, or the adjustable planing device 400 can be manufactured as part of the pontoon boat.

Optionally, an angle indicator gauge (not illustrated) is mounted on the cross-member 421 of the modular frame 420, a sending unit (not illustrated) is mounted on a console of the pontoon boat, and an adjustable arm (not illustrated) is mounted between the cross-member 421 and the rear end portion 444 of the buoyant planing device 440. The operator of the boat uses the sending unit to operate the adjustable arm to rotate the planing device 440 about the hinge 482 to a desired angle as indicated on the sending unit.

DEFINITIONS AND ALTERNATIVES

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to the following terms or common variations thereof:

Level position—includes the elevation of the planing device relative to the waterline when the planing device is attached to a pontoon boat. The level position is measured relative to the length of the planing device as measured from the front end portion opposite the rear end portion wherein both of the front and the rear end portions engage the waterline substantially the same or very similar distance to lift the pontoon boat. The front end portion is at least partially in the water to improve steering and increase buoyancy.

Lowered position—includes the elevation of the planing plate or planing device relative to the waterline when the planing plate or device is attached to a boat. The lowered position is measured relative to the rear end of the planing plate or planing device wherein the rear end of the planing plate engages the waterline a distance further than the front end to lift the pontoon boat. In one example, the rear end of the planing plate is level with the bottom of the pontoons of a pontoon boat when in a lowered position. In another example, the rear end of the planing plate is much lower than the bottom of the pontoons of a pontoon boat when in a lowered position.

Midship region—refers to the location of a boat or a pontoon boat that spans between a front end and a rear end of the boat or pontoon boat. In one example, the midship region includes the center of the boat or pontoon boat and extends equidistantly from the center towards the front end and the rear end of the boat. In another example, the midship region includes the center of the boat or pontoon boat and extends a first distance from the center towards the front end and extends a second distance from the center towards the rear end wherein the first distance is not equal to the second distance.

Modular frame—includes a structure that is configured to directly or indirectly attach to a boat. The modular frame can have a unitary construction or can be made from multiple pieces coupled together. In one example, the modular frame includes four components, a front member, a rear member, a right member, and a left member, but in other examples the modular frame can include more than four components. In another example, the modular frame includes one component such as a front member that is configured to couple with a planing plate or a planing device. In some embodiments, the front member of the modular frame is configured to attach to a boat and in other embodiments the modular frame is configured to move along one or more mounting rails that are attached to the boat to enable longitudinal adjustment of the modular frame relative to the boat.

Planing plate—includes a structure having a front end opposite a rear end wherein the front end is configured to rotatably attach to the modular frame and the rear end is configured to engage the waterline. The planing plate can have a unitary construction or can be made from multiple pieces coupled together. In one example, the planing plate is a single element. In other examples, the planing plate includes one, two, three, or more elements that can operate independently of each other or the multiple elements are attached together to operate as a single element.

Raised position—includes the elevation of the planing plate or planing device relative to the waterline when the planing plate or device is attached to a boat. The raised position is measured relative to the rear end of the planing plate wherein the rear end of the planing plate is above the waterline and does not engage the water. The raised position is measured relative to the rear end portion of the planing device wherein the rear end portion is above the waterline and does not engage the water.

Rotation—the act or process of moving or turning around a point or axis.

It should be noted that the singular forms "a", "an", "the", and the like as used in the description and/or the claims include the plural forms unless expressly discussed otherwise. For example, if the specification and/or claims refer to "a device" or "the device", it includes one or more of such devices.

It should be noted that directional terms, such as "upper", "lower", "top" "bottom", "first", "second", "front", "rear", etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation unless stated otherwise in the application.

The above assemblies and components may be made by any materials and processes apparent to be suitable. In particular, the modular frame, planing plate, planing device, mounting rails, skirt plate, first longitudinal planing plate, and second longitudinal planing plate may include a metal, a plastic, a composite material such as carbon fiber, a fiber reinforced material, or a combination of some or all of these materials.

Additionally, variations on the above-described assemblies, components, and features are contemplated. For example, the modular frame may be modified to attach to a boat in a different manner than disclosed.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. An adjustable planing device for a pontoon boat, the pontoon boat having a midship region that spans between a front end and a rear end, the adjustable planing device comprising:

a connector member having a transverse hinge configured to attach to the midship region of the pontoon boat;

a buoyant planing device having a front end portion opposite a rear end portion, the buoyant planing device attached to the connector member at the midship region beneath the boat and being pivotable about the hinge such that at least a portion of the buoyant planning device comprises a subsurface volume below water level;

the subsurface volume having an average density less than a one kilogram per liter density of water;

a powered actuator connected to the boat and to the buoyant planing device, the actuator operable to move the buoyant planing device downwardly into the water; and, a track mountable to the bottom of the boat, wherein the planing device, the connector member, and the powered actuator are selectively movable together along the track forward and aft with respect to the boat.

2. The adjustable planing device of claim 1 further comprising:

a first sponson attached to a right side of the buoyant planing device; and a second sponson attached to a left side of the buoyant planing device, wherein the first and the second sponsons are configured to contact the waterline to lift the pontoon boat.

3. The adjustable planing device of claim 1 further comprising:

a modular frame having a front member opposite a rear member, a right member opposite a left member, wherein the right and left members, respectively, span between the front member and the rear member, and wherein the modular frame is attachable to the track and the connector member is attached to the front member of the modular frame, the modular frame being selectively movable along the track forward and aft with respect to the boat.

4. The adjustable planing device of claim 3 further comprising:

the connector member having a first set of interacting features, the connector member attached to the front member of the modular frame; and a vertical member having a second set of interacting features, the vertical member mounted to the front end portion of the buoyant planing device, wherein the first and second sets of interacting features are configured to connect with each other to attach the vertical member to the connector member at a desired vertical position such that the buoyant planing device is selectively positioned vertically relative to the pontoon boat.

5. The adjustable planing device of claim 3 further comprising:

a mounting member attached to a top surface of the buoyant planing device, wherein the powered actuator is attached to the mounting member and the modular frame.

6. The adjustable planing device of claim 5 wherein the powered actuator is attached to the rear member of the modular frame.

7. The adjustable planing device of claim 5 further comprising:

a cross-member that extends between the right and the left members of the modular frame wherein the powered actuator is attached to the cross-member of the modular frame.

8. The adjustable planing device of claim 1 further comprising:

a drive assembly attached to the midship region of the pontoon boat wherein the drive assembly is configured to move the buoyant planing device, the connector member, and the powered actuator forward and aft with respect to the boat.

9. The adjustable planing device of claim 1, wherein the powered actuator includes one or more of a hydraulic actuator, a mechanical actuator, or an electrical actuator.

10. An adjustable planing device for a pontoon boat, the pontoon boat having a midship region that spans between a front end and a rear end, the adjustable planing device comprising:

a connector member having a transverse hinge configured to attach to the midship region of the pontoon boat;

a planing device having a front end portion opposite a rear end portion, the planing device attached to the connector member at the midship region beneath the boat and being pivotable about the hinge such that at least a portion of the planing device comprises a subsurface portion below water level;

a powered actuator connected to the boat and to the planing device, the actuator operable to move the planing device downwardly into the water; and, a track mountable to the bottom of the boat, wherein the planing device, the connector member and the powered actuator are selectively movable together along the track forward and aft with respect to the boat.

11. The adjustable planing device of claim 10 further comprising:

a modular frame having a front member opposite a rear member, a right member opposite a left member, wherein the right and left members, respectively, span between the front member and the rear member; and the track includes a first mounting rail and a second mounting rail, the first and the second mounting rails mountable to the bottom of the boat wherein the first mounting rail is configured to receive the right member of the modular frame and the second mounting rail is configured to receive the left member of the modular frame, wherein the modular frame, the planing device, the connector member and the powered actuator are selectively movable together along the first and the second mounting rails.

12. The adjustable planing device of claim 10 further comprising:

a first sponson attached to a right side of the planing device; and a second sponson attached to a left side of the planing device, wherein the first and the second sponsons are configured to contact the waterline.

13. The adjustable planing device of claim 10 wherein the front end portion of the planing device has a vee cross-sectional shape.

14. The adjustable planing device of claim 13 wherein the rear end portion of the planing device has a semi-circular cross-sectional shape.

15. The adjustable planing device of claim 10 further comprising:

wherein the connector member also has a first set of holes;

a vertical member mounted to the planing device, the vertical member having a second set of holes, wherein the first and the second sets of holes are arranged to align with each other; and a plurality of fasteners that mount through the first and the second sets of holes to attach the connector member to the vertical member to selectively adjust a vertical position of the planing device.

16. The adjustable planing device of claim 10 further comprising:

a drive assembly attached to the midship region of the pontoon boat wherein the drive assembly is configured to move the planing device, the connector member and the powered actuator along the track.

17. The adjustable planing device of claim 10 wherein the rear end portion of the planing device is movable to a lower vertical position from a minimum of about 3 inches to a maximum of about 17 inches.

18. The adjustable planing device of claim 10 further comprising:

a drive assembly attached to the midship region of the pontoon boat wherein the drive assembly is configured to move the buoyant planing device, the connector member, and the powered actuator forward and aft with respect to the boat.

19. The adjustable planing device of claim 10, wherein the powered actuator includes one or more of a hydraulic actuator, a mechanical actuator, or an electrical actuator.

20. An adjustable planing device for a pontoon boat, the pontoon boat having a midship region that spans between a front end and a rear end, the adjustable planing device comprising:

a connector member having a transverse hinge configured to attach to the midship region of the pontoon boat;

a planing device having a front end portion opposite a rear end portion, the planing device attached to the connector member at the midship region beneath the boat and being pivotable about the hinge midship such that at least a portion of the planing device comprises a subsurface portion below water level;

a powered actuator connected to the boat and to the planing device, the actuator operable to move the planing device downwardly into the water;

a vertical member mountable to the planing device and to the connector member, wherein the planing device and the vertical member are selectively movable together vertically up and down with respect to the boat to vary how deep into the water the powered actuator moves the planing device downwardly into the water; and a track mountable to the bottom of the boat, wherein the planing device, the connector member, the powered actuator, and the vertical member are selectively movable together along the track forward and aft with respect to the boat.

21. The adjustable planing device of claim 20 further comprising:

wherein the connector member having a first set of connecting features; and the vertical member having a second set of connecting features, wherein the first and second sets of connecting features are configured to connect with each other such that the planing device and the vertical member are selectively movable together vertically up and down with respect to the boat.

22. The adjustable planing device of claim 20 further comprising:

a modular frame having a front member opposite a rear member, a right member opposite a left member, wherein the right and left members, respectively, span between the front member and the rear member, the connector member attached to the front member; and the track includes a first mounting rail and a second mounting rail mountable to the pontoon boat, the first mounting rail configured to receive the right member of the modular frame and the second mounting rail configured to receive the left member of the modular frame, wherein the position of the modular frame, the connector member, the planing device, and the powered actuator are selectively movable together along the first and the second mounting rails.

23. The adjustable planing device of claim 20 further comprising:

a first sponson attached to a right side of the planing device; and a second sponson attached to a left side of the planing device, wherein the first and the second sponsons are configured to contact the waterline.

* * * * *